US005115835A

United States Patent [19]

Ueno

[11] Patent Number: 5,115,835

[45] Date of Patent: May 26, 1992

[54] STACKED TYPE HYDRAULIC CONTROL VALVE SYSTEM

[75] Inventor: Katsumi Ueno, Saitama, Japan

[73] Assignee: Zexel Corporation, Tokyo, Japan

[21] Appl. No.: 643,778

[22] Filed: Jan. 22, 1991

[30] Foreign Application Priority Data

Jan. 26, 1990 [JP] Japan ..... 2-14906
May 18, 1990 [JP] Japan ..... 2-126995

[51] Int. Cl.[5] ..... F15B 13/08; F15B 13/09

[52] U.S. Cl. ..... 137/596.13; 60/427; 60/428; 91/6; 91/513

[58] Field of Search ..... 60/427, 428; 91/6, 513; 137/596.13

[56] References Cited

U.S. PATENT DOCUMENTS 4,528,892 7/1985 Okabe et al. ..... 91/6
4,561,824 12/1985 Okabe et al. ..... 91/6 X

FOREIGN PATENT DOCUMENTS 60-263710 12/1985 Japan .
63-34304 2/1988 Japan .
63-83405 4/1988 Japan .
63-219905 9/1988 Japan .

*Primary Examiner*—Gerald A. Michalsky
*Attorney, Agent, or Firm*—Nields & Lemack

[57] ABSTRACT

A hydraulic control valve which is equipped with two direction change-over valve groups individually having traveling change-over valves, and first and second hydraulic pumps corresponding to those direction change-over valve groups. The traveling section valve of one of the change-over groups is equipped with a communication valve. Each section valve has its valve body formed therethrough with signal conduits individually extending perpendicular to spool bores. The two traveling section valves are formed with annular grooves in spool bores positioned to correspond to said signal conduits. The individual working machine section valves other than the traveling section valves are formed with annular grooves in the spool portions corresponding to the signal conduits to provide the communications between the upstreams and downstreams of the signal conduits only when the spools are in their neutral states. If the working machine section valves are operated while actuating the traveling section valves, the signal conduits are shut off in accordance with the movements of the spools to raise the pressures in the operation signal conduits. This raised pressure actuates the communication valves so that the discharged oil of the second hydraulic pump may merge through the communication conduits of the two direction change-over valve groups and may be introduced into the traveling section valves short of the oil.

14 Claims, 18 Drawing Sheets

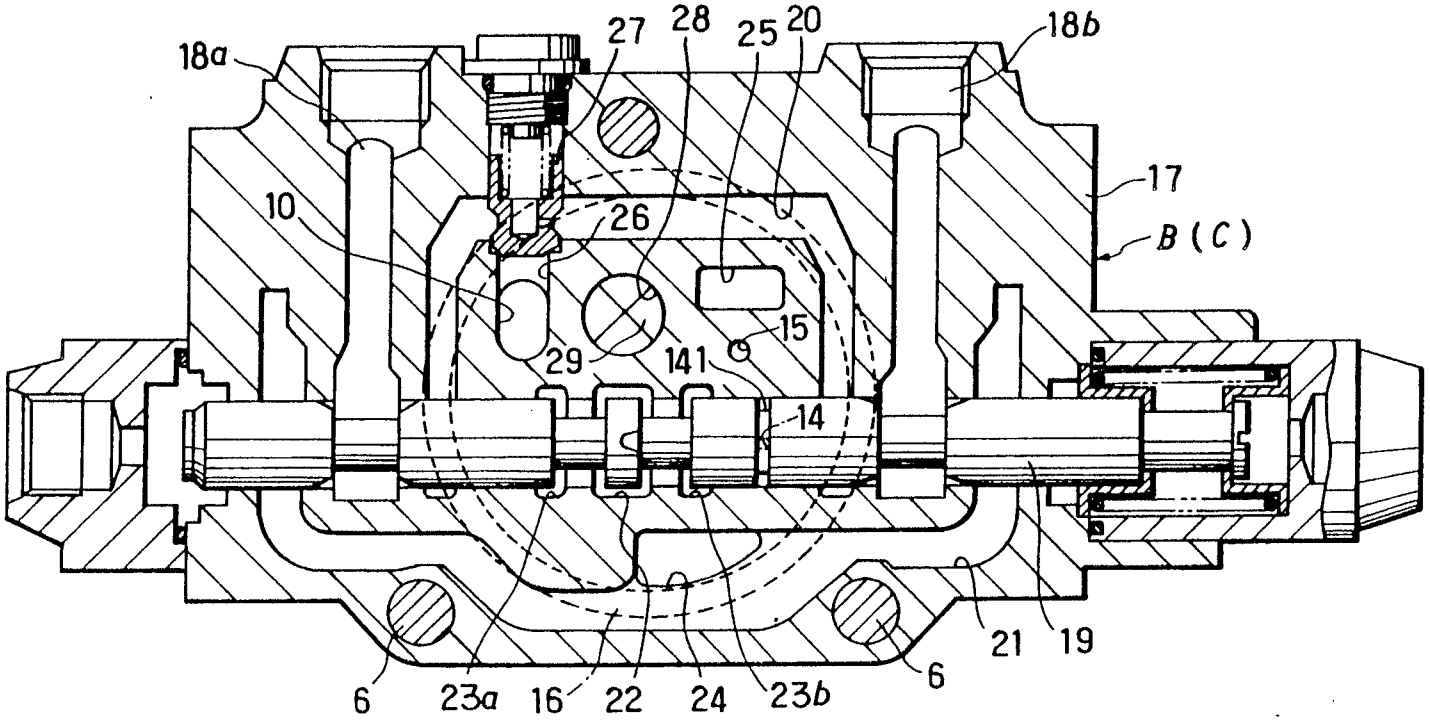
Fig. 5
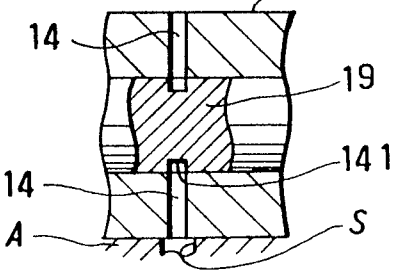
Fig. 5-A

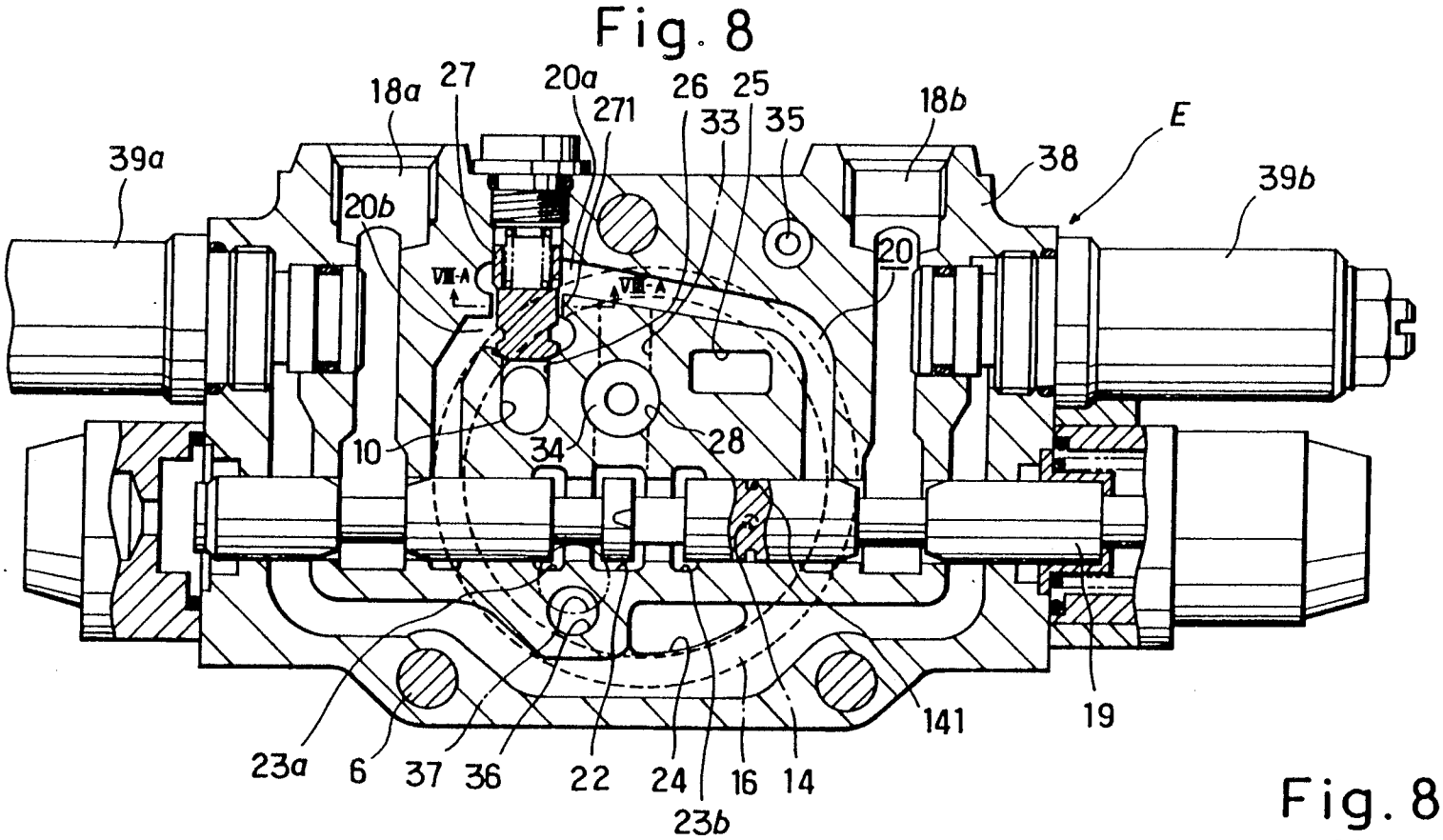
Fig. 8
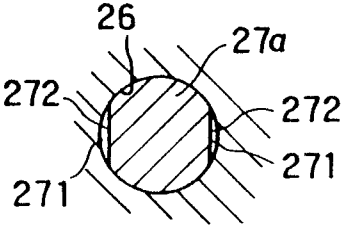
Fig. 8-A

Fig. 22-A
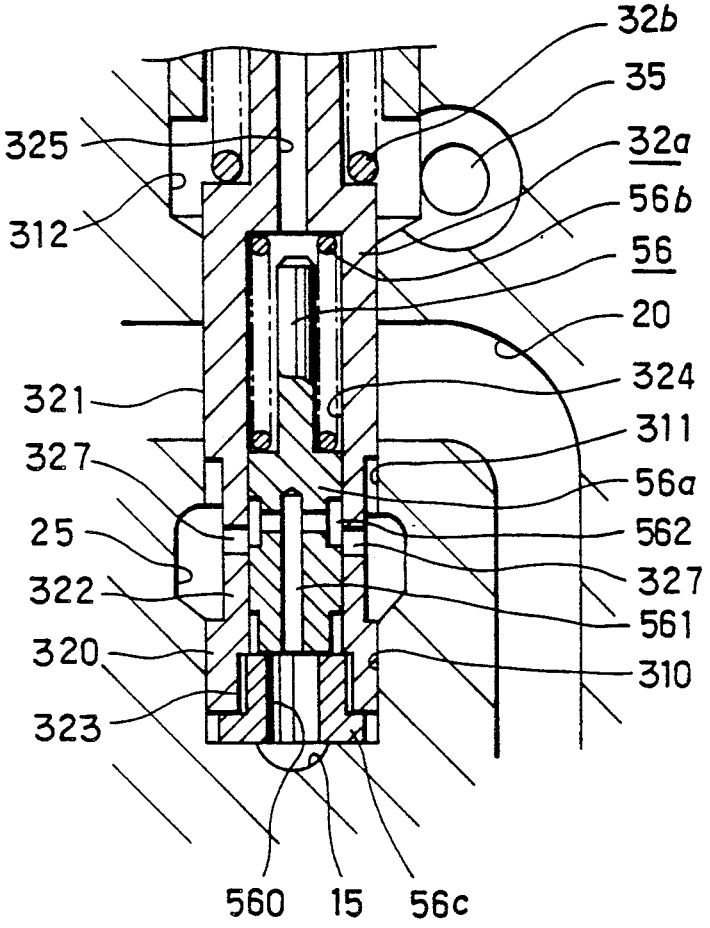

STACKED TYPE HYDRAULIC CONTROL VALVE SYSTEM

FIELD OF THE INVENTION

The present invention relates to a stacked type hydraulic control valve and, more particularly, to a stacked type hydraulic control valve system which is mounted in a traveling type hydraulic machine represented by a hydraulic shovel and suited for controlling a plurality of hydraulic actuators relative to each other.

BACKGROUND OF THE INVENTION

In a traveling type hydraulic machine such as a hydraulic shovel, a traveler (e.g., crawler) to be driven by a traveling motor is overlaid by a swivel slide to be swiveled by a swiveling motor. To this swivel slide, there is mounted a boom to be actuated by a boom cylinder. To this boom, there is attached an arm to be actuated by an arm cylinder. To this arm, there is attached a bucket to be actuated by a bucket cylinder.

As a hydraulic control system for such traveling hydraulic machine, there has been frequently adopted a two-pump system which uses two hydraulic pumps as its oil pressure source. Specifically, the first hydraulic pump is connected to a first direction change-over valve group composed of a plurality of change-over valves, and the second hydraulic pump is connected to a second direction change-over valve group composed of a plurality of direction change-over valves. Generally speaking, for example, a traveling righthand change-over valve, a bucket change-over valve and a boom I change-over valve belong to the first direction change-over valve group, and a traveling lefthand change-over valve, a swiveling change-over valve, an arm change-over valve and a boom II change-over valve belong to the second direction change-over valve group. Moreover, these change-over valves are generally constructed as stacked type control valves.

The performance required of these control valves is that a necessary amount of oil under pressure be fed to righthand and lefthand traveling motors when at least one of the hydraulic actuators of the aforementioned front working machines (e.g., the boom, the arm, the bucket or the swivel slide) is operated simultaneously with the traveling motor. This performance is necessary for ensuring the excellent forward travel of the traveler. From the aspect of safety, moreover, a sufficient amount of oil is desirably fed to a swivel actuator when this actuator is operated during the travel. It is also desired as well as the above-specified performance that the stacked state be small-sized and compact to require no large space for mounting and that the piping can be accomplished simply at a reasonable cost. However, the prior art has failed to provide a practical control valve capable of satisfying the above-specified desires.

Specifically, the control valve for controlling the hydraulic shovel is disclosed in Japanese Patent Laid-Open Nos. 263710/1985, 83405/1988, 34304/1988 and 219905/1988.

However, these prior art technologies are directed to a hydraulic circuit mainly for controlling the simultaneous operations of the arm and the swivel. Specifically, one direction change-over valve group is equipped with a merging direction change-over valve, which is operated to feed the arm direction change-over valve with a merging oil under pressure coming from the first hydraulic pump and the second hydraulic pump. Therefore, the hydraulic circuit cannot solve the problem coming from the simultaneous operations of the traveling motor and another actuator. In case the front working machine such as the arm is moved during the travel, the more oil under pressure will flow into the arm cylinder under the lighter load. As a result, the feed of the oil under pressure to the traveling motor belonging to the group shared with the arm cylinder becomes short so that the problem of curved travel has failed to be solved.

For this solution, it is necessary to establish the communication between the traveling two direction change-over valves. This communicating mechanism according to the prior art cannot be provided without equipping the prime mover with external pipings or electromagnetic valves. These equipments have raised the cost and caused another problem of large space for mounting the valves.

From the composite operability of the swivel and arm, on the other hand, it is desirable at the time of the composite operations of the arm lowering and swiveling operations to feed sufficient oil under pressure to the swiveling motor of a higher load while restricting the inflow of the oil to the arm cylinder of a lighter load, it is also desired at the time of the composite operations of the arm lifting and swiveling operations to feed the oil under pressure to the arm cylinder from parallel circuits not through any throttle. Despite this fact, however, the prior art has failed to provide a compact and practical valve structure for realizing that function.

SUMMARY OF THE PRESENT INVENTION

An object of the present invention is to provide a stacked type hydraulic control valve which comprises two direction change-over groups adapted to be fed with oil under pressure, respectively, from a first hydraulic pump and a second hydraulic pump and which is enabled to detect an operation signal automatically when a front working machine is operated during the travel of a traveler, to feed merging oil from the two hydraulic pumps to the traveling change-over valve of the change-over valve group for the direction change-over valve of the operated front working machine, and to realize that function by using neither any external piping nor any electromagnetic valve.

A second object of the present invention is to provide a stacked type hydraulic control valve which is advantageous in reducing the cost and the space for the prime mover and enabled to extract and operate the pressure from the hydraulic circuit in the stacked valve by using any special pump as a pilot oil pressure source for the detection of the aforementioned operation signal and the merging operation.

A third object of the present invention is to provide a stacked type hydraulic control valve which is enabled to easily seal a number of passages and ports leading to the individual direction change-over valves by using no special sealing member such as a spacer block and to make the structure more compact and reduce the cost to a lower value.

A fourth object of the present invention is to provide a stacked type hydraulic control valve which is enabled to adjust the balance among the amounts of working oil to the individual actuators of a plurality of front working machines properly with a simple structure, when the front working machines are simultaneously operated (that is, to combine a parallel passage and a tandem passage skillfully and connect them through a throttle).

A fifth object of the present invention is to provide a stacked type hydraulic control valve which is enabled to accommodate the load check valves of the parallel passage and the tandem passage simply within a small space without requiring any special seal.

A sixth object of the present invention is to provide a stacked hydraulic control valve which is enabled to simply realize the merging and separation of the passages between the individual direction change-over valves (or section valves).

According to the present invention, there is provided a hydraulic control valve of the type, which comprises: a first direction change-over valve group connected to a first hydraulic pump; and a second direction change-over valve group connected to a second hydraulic pump, said first direction change-over valve group including one connection plate, one traveling section valve and a plurality of working machine section valves, said second direction change-over valve group including one connection plate, one traveling section valve and a plurality of working machine section valves, all of said section valves are stacked together with said connection plates, which valve is characterized:

(1) in that said connection plates respectively include pump ports to be fed with the discharged oil from said first hydraulic pump and said second hydraulic pump, and tank ports leading to tanks;

(2) in that the section valves of said first change-over valve group and said second change-over valve group individually have communication passages which are formed in their valve bodies near bridge passages for causing the discharged oil of said second hydraulic pump to merge into the discharged oil of said first hydraulic pump, and in that said bridge passage and a communication passage in the traveling section valve of said second change-over valve group are connected to each other through a check valve;

(3) in that said section valves have their valve bodies formed therethrough with signal conduits on line and at a right angle with respect to spool bores, in that both of said traveling section valves are formed with annular grooves which are formed in the bores of spools in positions corresponding to said signal conduits for providing communications between the upstreams and downstreams of said signal conduits irrespective of the positions of said spools, in that said working machine section valves other than said traveling section valves are individually formed in their spool portions with annular grooves for providing communications between the upstreams and downstreams of said signal conduits only when said spools are in their neutral states, and in that said signal conduits have their most downstreams connected with tank passages in the connection plate of said second change-over valve group;

(4) in that the working machine section valves and the traveling section valve of said first change-over valve group are individually formed with operation signal conduits between said communication passages and said spool bores, and in that said operation signal conduits have their upstreams communicating with the most upstreams of said signal conduits in the connection plate of said first change-over valve group; and (5) in that said traveling section valve has its valve body formed with a vertical hole which so extends at right angles with respect to said bridge passages and said communication passage as to reach said operation signal conduit, in that a communication valve is fitted in said vertical hole, and in that said communication valve normally blocks the communication between said communication passage and said bridge passage and is lifted, when the pressure in the operation signal conduit is raised as a result of blocking said signal conduit by operating the working machine section valve, to provide the communication between said communication passage and said bridge passage, whereby the communication between the other communication passage and said communication passage is provided to introduce the discharged oil of said second hydraulic pump into said bridge passage.

According to a proper aspect of the present invention, the working machine section valves of said first direction change-over valve group are provided for working machines of the kind to be also used for travels, and the working machines of said second direction change-over valve group are provided for working machines to be used not for the travels.

Said first direction change-over valve group is arranged in its most upstream with said working machine section valves having higher priorities and downstream of the former with said traveling section valve.

Said second direction change-over valve group is arranged in its most upstream with said traveling section valve and downstream of the former with said working machine section valves.

According to the above-specified structure, in case of travel only, the oil under pressure is fed from the first hydraulic pump to the traveling section valve of the first direction change-over valve group, and the oil under pressure is fed from the second hydraulic pump to the traveling section valve of the second direction change-over valve group. Even if the spools of the two traveling section valves are operated, the signal conduit is not blocked by the ring groove formed in the spool bore so that no pressure is raised in the operation signal conduit. As a result, the communication valve disposed in the traveling section valve of the first direction change-over valve group is not operated.

In case, on the other hand, the working machine section valve belonging to the first direction change-over valve group is operated during the travel, the oil under pressure is sucked by the working machine section valve so that the amount of oil of the traveling section valve is reduced. Since, however, the signal conduit is blocked by the movement of the spool of the working machine section valve, a pressure is established in the operation signal conduit. By this pressure, the communication valve disposed in the traveling section valve of the first direction change-over valve is operated.

Thus, the communications are provided between the communication passages of the first direction change-over valve group and the second direction change-over valve group. Since the discharged oil of the second hydraulic pump is shunted through the check valve to the communication passage of the second direction change-over valve group, it merges into the traveling section valve of the first direction change-over valve group. As a result, the shortage of the oil to the traveling section valve of the first direction change-over valve group can be compensated to equalize the oil amounts for the two traveling section valves thereby to ensure an excellent straight travel.

The structure for achieving other objects will become apparent from the following description but should not be limited to the modes of embodiment so long as it is included in the basic technical concept of the present invention.

BRIEF DESCRIPTION OF THE DRAWINGS

FIG. 5 is a section showing a swivel section valve and a boom II section valve;

FIG. 5-A is a transverse section showing a portion of the same;

FIG. 8 is a section showing an arm section valve;

FIG. 8-A is a section taken along line VIII—VIII of FIG. 8;

FIG. 10-A is a section showing swivel and boom II section valves and taken at the center of the tandem passage;

FIG. 10-B is a section showing a bucket section valve and a traveling section valve of the second direction change-over valve group and taken at the center of the tandem passage;

FIG. 22-A is an enlarged view showing a portion of the same.

DETAILED DESCRIPTION OF THE PREFERRED EMBODIMENTS OF THE INVENTION

The present invention will be described in the following in connection with the embodiments thereof with reference to the accompanying drawings.

Figure 1:
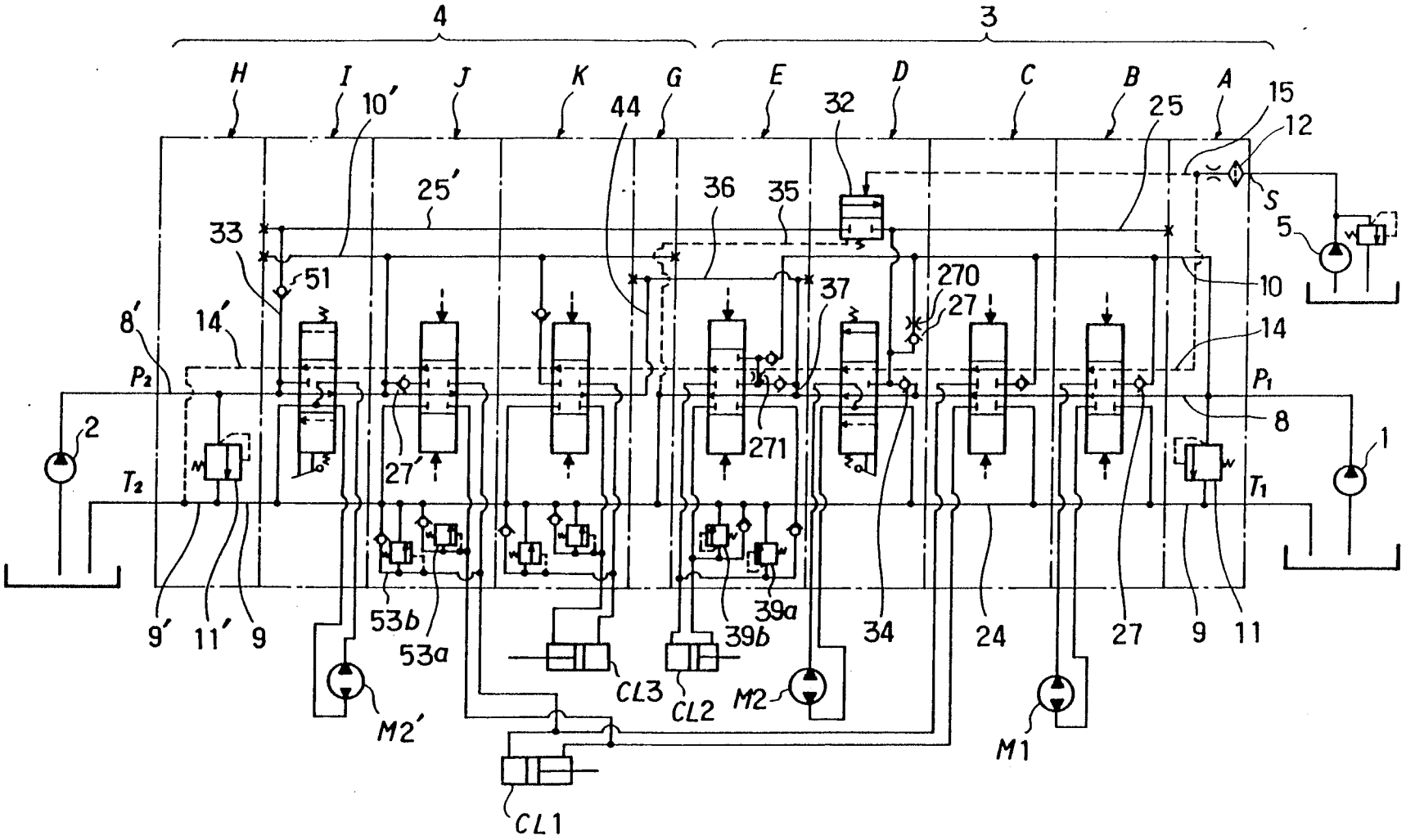
FIG. 1 is a circuit diagram showing a first embodiment of a hydraulic circuit to which a stacked type hydraulic control valve according to the present invention is applied.
Figure 2:
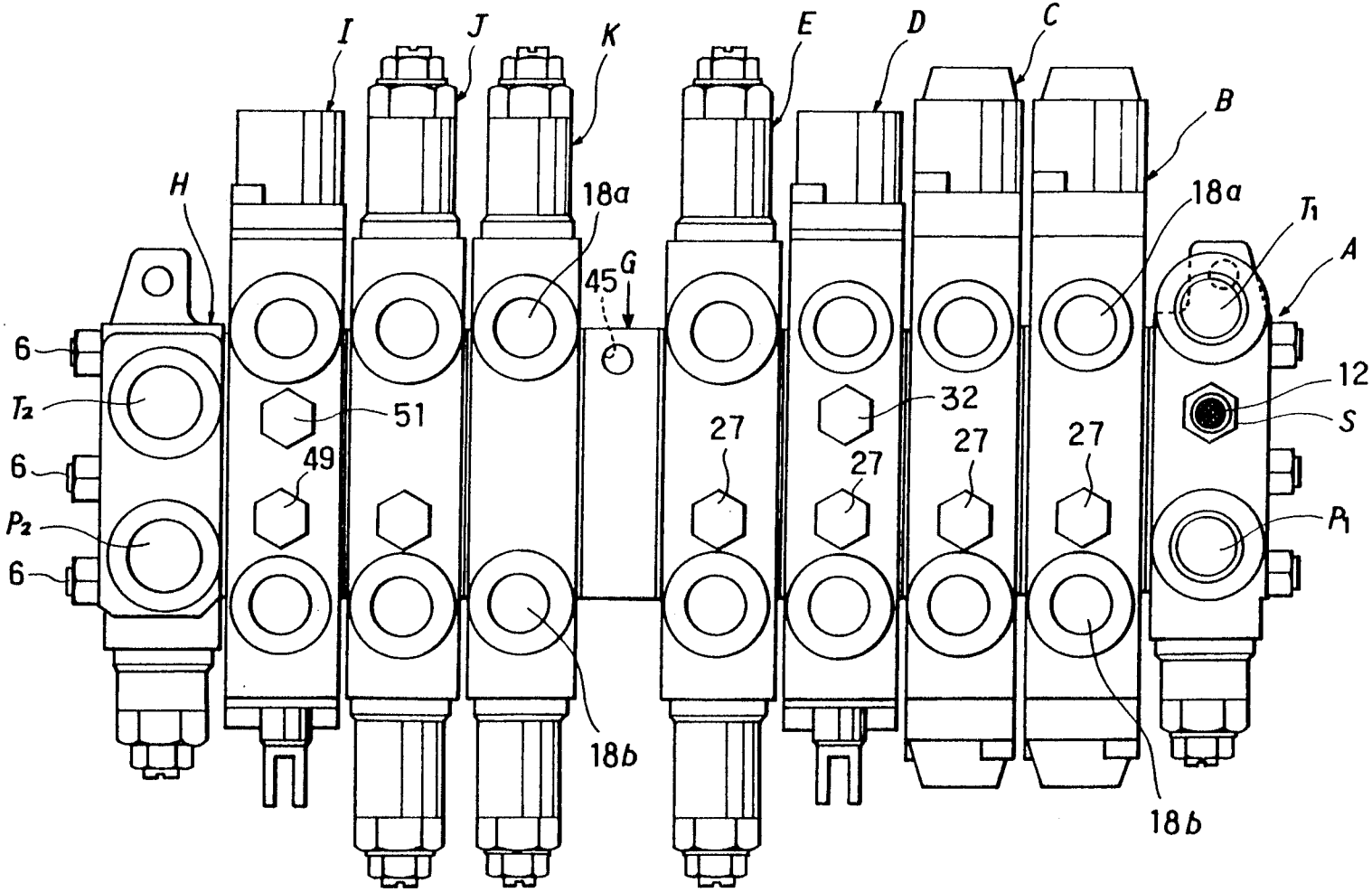
FIG. 2 is a top plan view showing the stacked type hydraulic control valve of the first embodiment.
Figure 17:
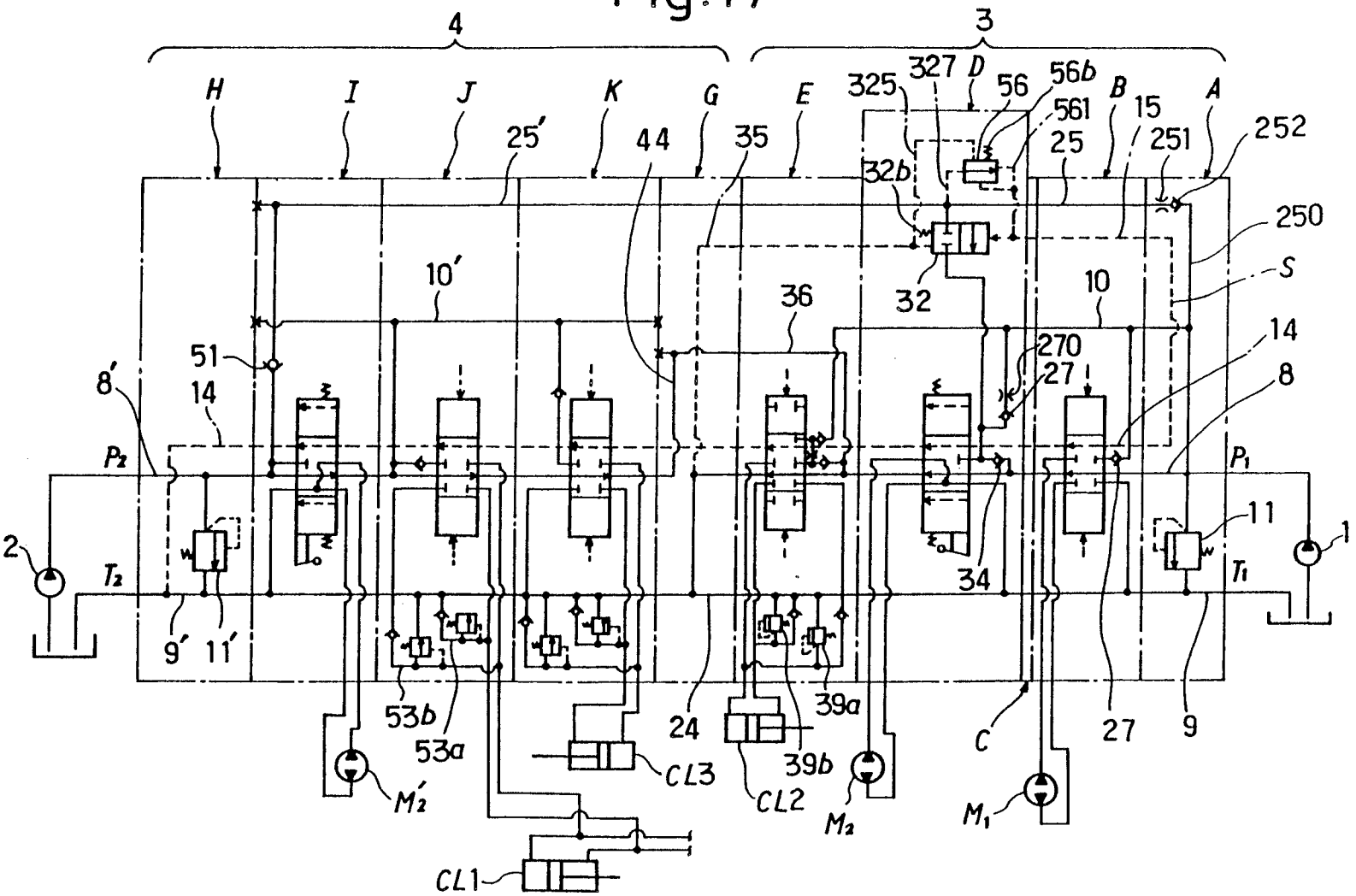
FIG. 17 is a circuit diagram showing a second embodiment of the hydraulic circuit to which the stacked hydraulic control valve according to the present invention is applied.
Figure 18:
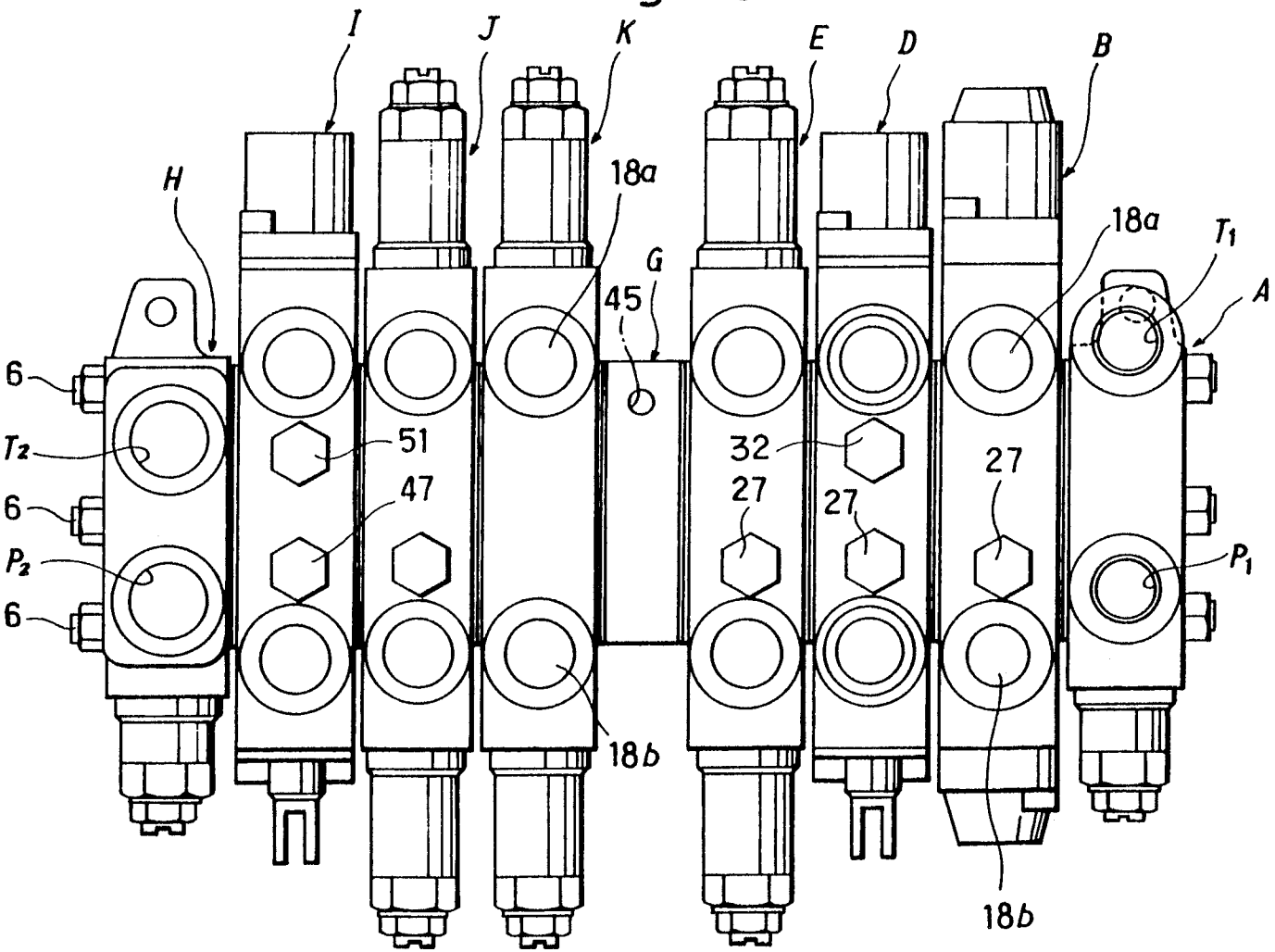
FIG. 18 is a top plane view showing a stacked type hydraulic control valve according to the second embodiment.

FIG. 1 shows a first embodiment of the oil pressure circuit of a hydraulic shovel which is obtained by using a stacked oil pressure control valve system according to the present invention, and FIG. 2 shows the whole structure of an oil pressure control valve according to the first embodiment. FIGS. 17 and 18 show a second embodiment.

In FIGS. 1 and 17, reference numeral 1 designates a first hydraulic pump, and numeral 2 designates a second hydraulic pump. These hydraulic pumps 1 and 2 are coaxially driven by a prime mover such as an engine.

Numeral 3 generally designates a first direction change-over valve group which is connected to the first hydraulic pump 1. To this first direction change-over valve group 3, there belong a section plate A, one traveling section valve D, and a plurality of section valves B, C and E for working machines. These working machine section valves B, C and E are all for working machines of the kinds to be operated simultaneously with the travel. Priorities of supply of oil under pressure to the working machine section valves B, C and E are determined from the aspect of aspect.

In this embodiment, the connection plate A, the swivel section valve B and the boom II section valve C are arranged from upstream to downstream in the recited order. The traveling section valve D is arranged downstream of the group, and the arm section valve E is arranged downstream of the section valve D.

Reference numeral 4 designates a second direction change-over valve group which is connected to the second hydraulic pump 2. To this second direction change-over valve group, there belong a connection plate H, one traveling section valve I, and a plurality of section valves J and K for working machines. These working machine section valves J and K are provided for working machines of the kind to be unused with the travel even if they are used together with the working machines belonging to the first direction change-over group 3. The traveling section valve I is arranged upstream of the working machine section valves J and K.

In this embodiment, the connection plate H, the traveling section valve I, the boom I section valve J and the bucket section valve K are arranged from upstream to downstream in the recited order. This second section is adjacent through a sub-plate G to the most downstream working machine section valve, i.e., the arm section valve E in this embodiment, of the first direction change-over valve group 3.

These first and second direction change-over valve groups 3 and 4 are fastened together by means of a plurality of stack bolts 6.

Next, the mechanisms of the individual valves of the (first) embodiment of FIGS. 1 and 2 will be described in the following.

Connection Plate A

Figure 3:
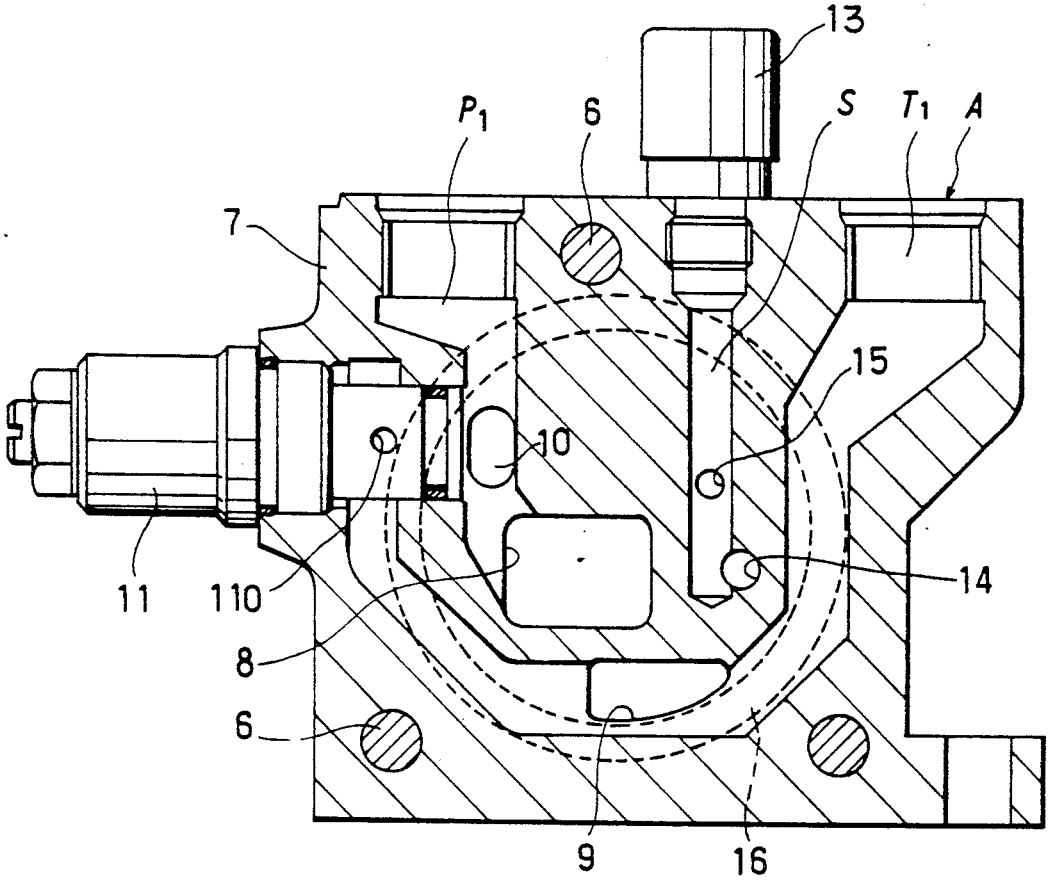
FIG. 3 is a section showing a connection plate of a first direction change-over valve group.
Figure 4:
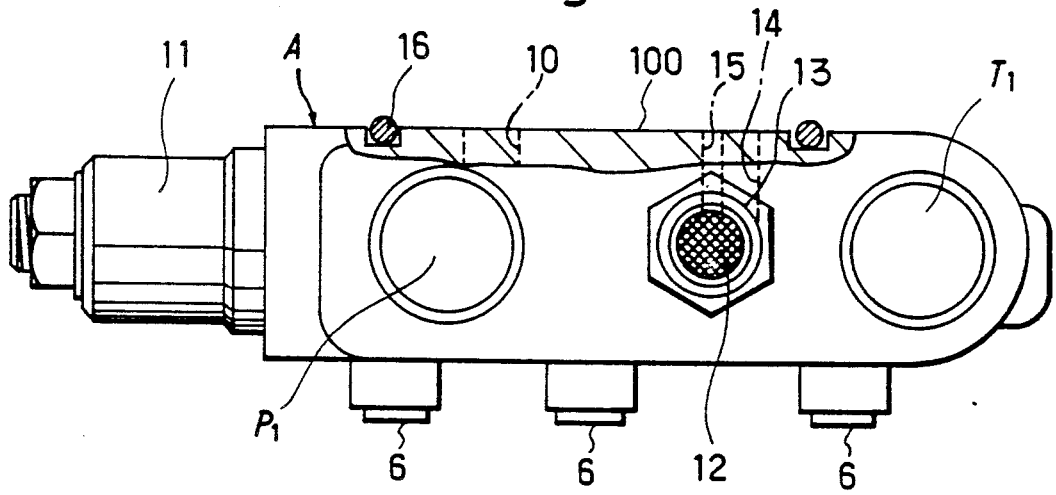
FIG. 4 is a partially cut-away top plan view showing the same.

FIGS. 3 and 4 show the connection plate A of the first direction change-over valve group 3. This connection plate A is formed in an intermediate portion of its body 7 with a feed passage 8 which is directed to a matching face 100. Moreover, the body 7 is formed with a pump plate $P_1$ leading to the feed passage 8 and an inverted bridge tank port $T_1$ leading to a tank passage 9 below the feed passage 8.

The pump port $P_1$ is formed, as shown in FIG. 4, with a cross pump passage 10 leading to the matching face 100. A relief valve 11 is crosswise fitted in the deep portion of the tank port $T_1$ and the pump port $P_1$, and a secondary opening 10 leads to the tank port $T_1$.

Between the pump port $P_1$ and the tank port $T_1$, there is vertically formed a blinded signal port S which extends from the top face of the body. To the entrance of the signal port S, there is fixed a connector 13 which is equipped with a filter 12 and a not-shown orifice. To the connector 13, there is connected a signal pump 5, as shown in FIG. 1. This signal pump 5 is used as a prime mover for a later-described communication valve and is practically driven simultaneously with the first hydraulic pump 1 and the second hydraulic pump 2 by the prime mover or engine.

The aforementioned signal port S is formed near the bottom with a signal conduit 14 which is opened in the matching face 100 and in the intermediate portion with an operation signal conduit 15 which is also opened in the matching face 100. The operation signal conduit 15 is given a larger diameter than that of the signal conduit 14.

The aforementioned feed passage 8, tank passage 9, pump passage 10, signal conduit 14 and operation signal conduit 15 are arranged so centrally in the inside region as not to deteriorate the strength of the body 7. One O-ring 16 is so fitted to the matching face 100 as to accommodate the aforementioned individual passages and conduits inside.

Swivel Section Valve B and Boom II Section Valve C

FIGS. 5 and 5*a* show the most upstream turning section valve B and the next boom II section valve C in their neutral states. Each of these section valve B and C is basically a 6-port 3-position change-over valve, in which a valve body 17 is formed with a pair of actuator ports 18*a* and 18*b* and in which a spool 19 is made slidable at a right angle with respect to the ports 18*a* and 18*b*. The spool 19 is operated in this embodiment by the pilot oil pressure, which is fed from the first hydraulic pump 1 and operated by a remote control valve or the like, although not shown.

The valve body 17 is formed a gate-shaped bridge passage 20 inside of the aforementioned actuator ports 18*a* and 18*b* and an inverted gate tank passage 21 outside of the same ports 18*a* and 18*b*. The valve body 17 is further formed in the spool bore inside of the bridge passage 20 with an entrance neutral passage 22 at the center and with exit neutral passages 23*a* and 23*b* at the two sides of the entrance neutral passage 22.

The aforementioned bridge passage 22, lefthand and righthand actuator ports 18*a* and 18*b* and tank passage 21 are switched by their rods and throats when the spool 19 is slid. On the other hand, the entrance neutral passage 22 and the exit neutral passages 23*a* and 23*b* are connected/disconnected by the central lands formed at the spool 19. The aforementioned tank passage 21 is formed with a returning tank port 24 which is located below the spool 19 and in a position to communicate with the tank passage 9 of the aforementioned connection plate A. Moreover, the entrance neutral passage 22 and the lefthand exit neutral passage 23*a* are positioned to communicate with the feed passage 8 of the aforementioned connection plate A.

The valve structure described above is similar to that of the stack valve existing in the prior art. In the present invention, on the contrary, between the bridge passage 20 and the spool bore and at the righthand position near the bridge passage 20, there is formed a through communication passage 25 which so extends at a right angle with respect to the bridge passage 20 as to reach the matching plate 100. The communication passage 25 has its one opening closed by the matching face 100 of the aforementioned connection plate A.

Moreover, at the same position as that of the pump passage 10 of the connection plate A, i.e., between the bridge passage 20 and the spool bore and near the bridge passage 20, there is formed a pump passage 10 which leads to the matching face 100. This pump passage 10 is made to communicate to the bridge passage 20 through a vertical hole 26 which is opened in the upper portion of the body 17. In this vertical hole 26, there is fitted a parallel load check valve 27 which is opened by the pressure of the working oil flowing through the pump passage 10 to establish communication between the bridge passage 20 and the pump passage 10.

Figure 10:
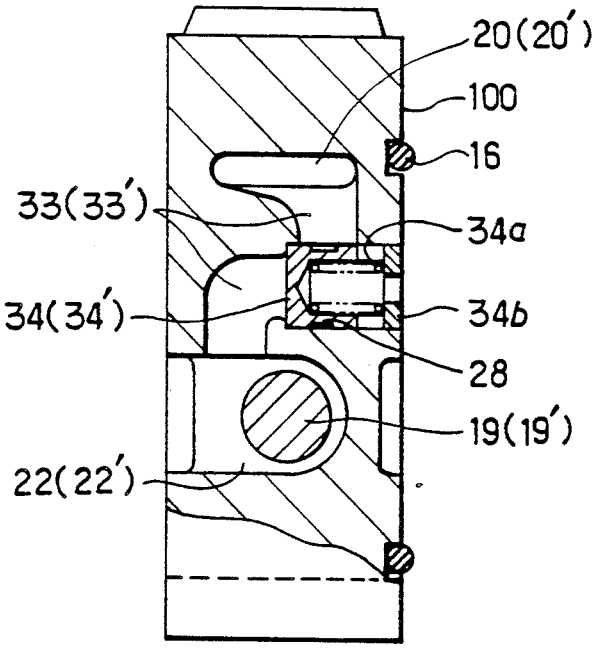
FIG. 10 is a section showing traveling, arm and boom I section valves and taken at the center of a tandem passage.
Figure 10:
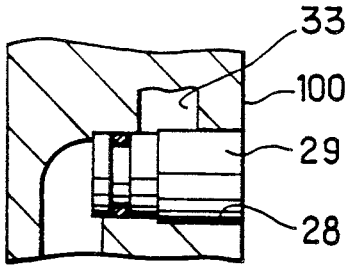
Figure 10:
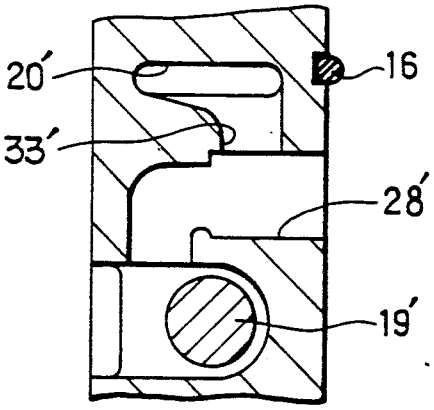

The aforementioned communication passage 25 is formed in the righthand corner of the gate-shaped bridge passage 20, and the pump passage 10 is formed in the lefthand corner. In the region between the communication passage 25 and the pump passage 10, i.e., above the entrance neutral passage 22, there is formed a hole 28 for fitting a tandem load check valve. This hole is opened in the matching face 100. The communication hole 28 is closed by a plug 29, as shown in FIG. 10-A.

Between the communication passage 25 and the spool bore, moreover, there is formed therethrough an operation signal conduit 15 which is coaxial with the signal conduit 15 formed in the connection plate A. The valve body 17 is further formed with a signal conduit 14 which extends across the spool bore. This signal conduit 14 is aligned with the signal conduit 14 of the connection plate A, as shown in FIG. 5-A. Moreover, the spool 19 is formed with a ring groove 141 which is given, in the neutral state, a width equal to the diameter of the signal conduit 14. As a result, the upstream and downstream of the signal conduit 14 are made to communicate with each other through the ring groove 141 only when the spool 19 is in its neutral state.

To the matching face 100 of the swivel section valve B and the boom II section valve C, there is fitted one O-ring 16, inside of which are arranged the entrance/exit neutral passages 22 and 23*a* and 23*b*, the communication passage 25, the communication hole 28, the signal conduit 14 and the operation signal conduit 15.

Incidentally, the actuator ports 18*a* and 18*b* of the swivel section valve B are connected with a turning motor M1, as shown in FIG. 1, and the actuator ports 18*a* and 18*b* of the boom II section valve C are connected with the piston and rod sides of a boom cylinder CL1.

Traveling Section Valve D

Figure 6:
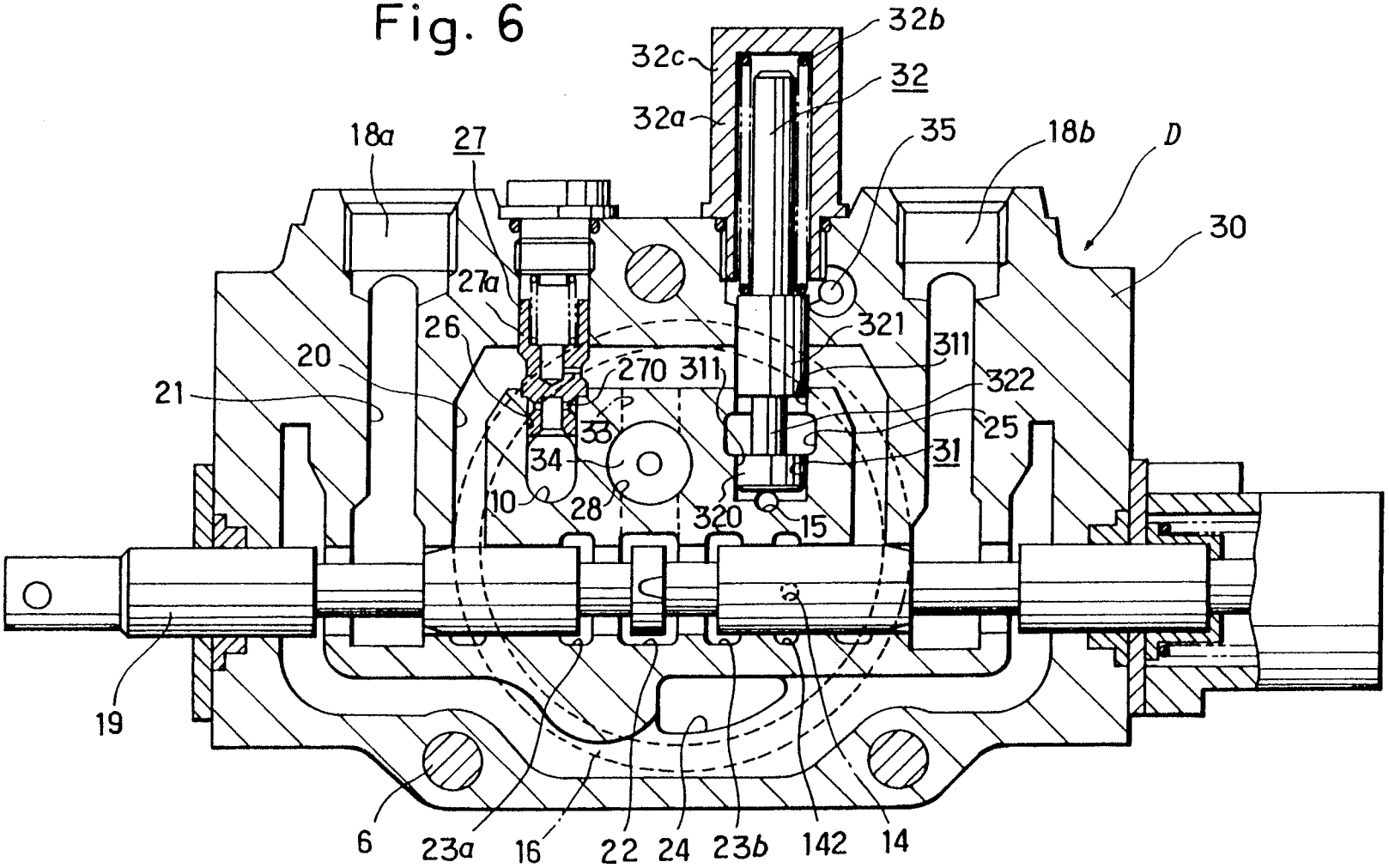
FIG. 6 is a section showing a traveling section valve.
Figure 7:
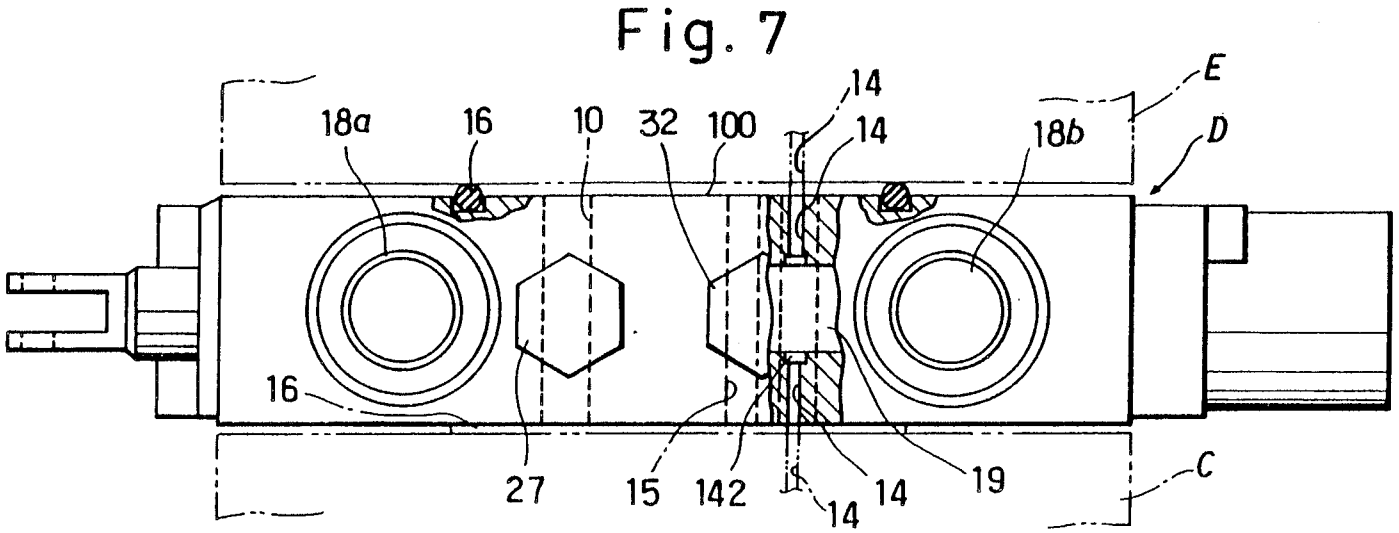
FIG. 7 is a partially cut-away top plan view showing the same.

Next, FIGS. 6 and 7 show the traveling section valve D. This traveling section valve D is identical to the foregoing swivel section valve B and boom section valve C, excepting that the spool 19 is of manual type. Specifically, the actuator ports 18*a* and 18*b*, the spool 19, the bridge passage 20, the tank passage 21, the entrance/exit neutral passages 22 and 23*a* and 23*b* and the tank port 24 are identical to those of the swivel section valve B and the boom section valve C. Thus, these components are designated at the common reference numerals, and their descriptions will be omitted.

This traveling section valve D has its valve body 30 formed therethrough with a communication passage 25 in the same position as that of the communication passage 25 of the aforementioned boom II section valve C and an operation signal conduit 15 in the same position as that of the operation signal conduit 15 of the boom II section valve C. In the traveling section valve D, however, there is formed a blinded vertical hole 31 which extends from the top face of the valve body 30 to the operation signal conduit 15 at a right angle with respect to the bridge passage 20 and the communication passage 25. As a result, the communication passage 25 is made to communicate with the operation signal conduit 15 via the vertical hole 31.

In this vertical hole 31, moreover, there is fitted a communication valve 32 for connecting/disconnecting the bridge passage 20 and the communication passage 25. The communication passage 32 is equipped with: a spool 32*a*; a spring 32*b* for urging the spool 32*a*; and a cap 32*c* for enclosing the spool portion projecting from the vertical hole 31 and for supporting the rear portion of the spring 32*b*.

First of all, more specifically, the spool 32*a* is formed with: a leading end land portion 320 fitted in the vertical hole portion 310 below the communication passage 25 and having its leading end face facing the operation signal conduit 15; a rear end land portion 321 fitted in a vertical hole portion 311 between the communication passage 25 and the bridge passage 20; and a rod portion 322 connecting those two land portions 320 and 321.

The spring 32*b* has its leading end abutting against the rear end face of the rear end land portion 321 thereby to close the spool 32*a* till the oil pressure in the operation signal conduit 15 facing the leading end land portion 320 is boosted to reach a predetermined level. FIG. 6 shows the valve closed state. Moreover, the chamber accommodating the spring 32*b* therein is formed with a drain conduit 35 which has its leading end leading to the matching face with the next arm section valve E.

Moreover, the traveling section valve D is formed therethrough with a pump passage 10 which is located in the same position as that of the boom II section valve C and which leads to the matching face 100. This pump passage 10 is connected with the bridge passage 20 through the vertical hole 26 which is formed in the top face of the valve body. Into this vertical hole 26, there is fitted the parallel load check valve 27 which is opened by the pressure of the working oil flowing in the pump passage 10 to feed the oil under pressure to the bridge passage 20. The parallel load check valve 27 is equipped with a throttle 270 in its valve member 27*a*.

Between the lefthand pump passage 10 and the righthand communication passage 25, moreover, there is formed a passage 28 which is located in the same position as that of the aforementioned boom II section valve C and opened in the matching face 100. This passage 28 is made to communicate with the entrance neutral passage 22 and the bridge passage 20 through a bent communication hole 33, as shown in FIG. 10. From the side of the matching face into the passage 28, there is inserted a cap-shaped tandem load check valve 34 which is urged to its closed side by a spring 34*a* and a washer 34*b*.

In case the structure described above is adopted, the tandem load check valve 34 can be assembled by using the matching face 100 as a stopper to eliminate neither the use of any plug nor the machining of any screw. Since, moreover, the communication passage 28 is formed inside of one large O-ring 16, no special sealing member is needed.

The valve body 30 is further formed with a signal conduit 14 which extends coaxially with the aforementioned boom II section valve C and at a right angle with respect to the spool bore. The signal conduit 14 leads to the matching face. Unlike the swivel section valve B and the boom II section valve C, a ring groove 142 is formed not in the spool 19 but in the spool bore, as shown in FIG. 7, and the leading end of the signal conduit 14 reaches to the ring groove 142. The ring groove 142 is given a larger width than the diameter of the signal conduit 14. As a result, this traveling section valve D is always given the communication between the upstream and downstream of the signal conduit 14, no matter what position the spool 19 might take, so that the signal oil coming from the signal conduit 14 of the boom II section valve C flows to the next arm section valve E.

The actuator ports 18*a* and 18*b* of the traveling section valve D are connected to a traveling hydraulic motor M2, as shown in FIGS. 1 and 17. In the matching face 100 of the valve body 30, there is fitted one O-ring 16, inside of which are arranged the pump passage 10, the signal conduit 14, the operation signal conduit 15, the entrance/exit neutral passages 22 and 23*a* and 23*b*, the tank ports 24 and 25 and the passage 28. This structure is common to the downstream individual section valves and will be given the reference numerals while its description is being omitted.

Arm Section Valve E

Figure 9:
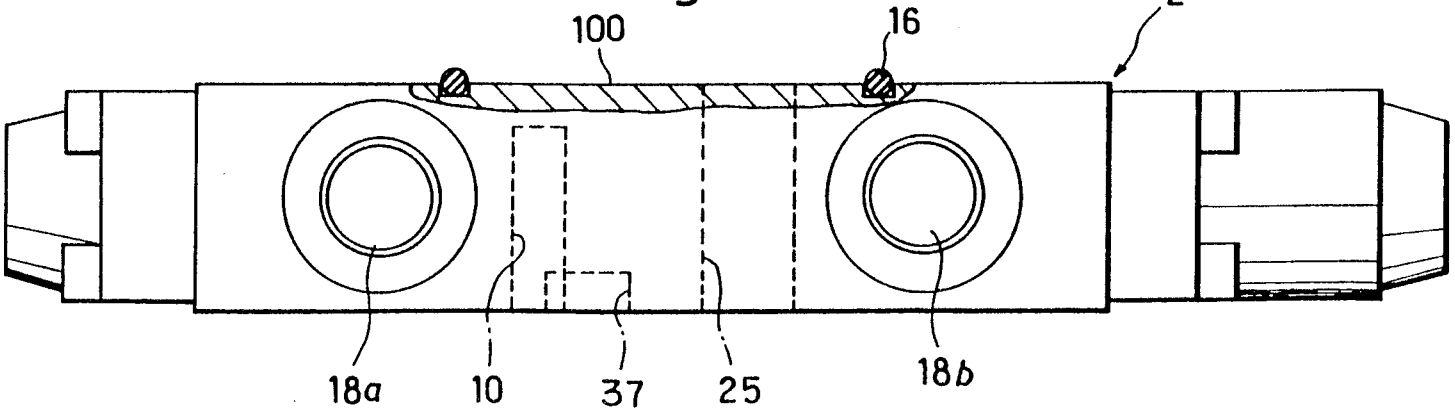
FIG. 9 is a partially cut-away top plan view showing the same.

FIGS. 8 and 9 show the arm section valve E. This section valve has a basic structure similar to those of other section valves, and a valve body has its paired actuator ports 18*a* and 18*b* connected with an arm cylinder CL2, as shown in FIGS. 1 and 17.

This arm section valve E is formed therethrough with a communication passage 25, which is in the same position as the communication passage 25 of the aforementioned traveling section valve D, and a communication hole 28 which is in the same position as that of the foregoing communication hole 28. The communication hole 28 of the arm section valve E connects the bridge passage 20 and the entrance neutral passage 22 through the communication hole 33, as shown in FIG. 10. In the communication hole 28, there is fitted a tandem load check valve 34 which uses the matching face 100 as a stopper face. The arm section valve E is further formed therethrough with the drain conduit 35 which is opened in the matching face in the same position as that of the drain conduit 35 of the traveling section valve D.

In this arm section valve E, the ceiling passage portion of the bridge passage 20 is made not continuous but is vertically out of shift in the lefthand upper end portion. Specifically, the lefthand upper end portion is staggered such that the end portion 20*a* extending from the righthand side is positioned above the end portion 20*b* extending from the lefthand side. Moreover, the bent communication passage 33 leading to the aforementioned passage 28 leads to the righthand (or upper) staggered end portion 20*a*.

The arm section valve E is formed with a pump passage 10 which is in the same position as the pump passage 10 of the aforementioned traveling section valve D. The pump passage 10 of the arm section valve E has only its upstream leading to the matching face but its downstream blinded, as shown in FIG. 9, unlike the through pump passages 10 of the traveling section valve D and the upstream section valves C and B. The vertical hole 26 is formed from the top face of the valve body and in the pump passage portion at this side of the hole bottom and extends through the two staggered end portions 20*a* and 20*b*, as shown in FIG. 8. A parallel load check valve 27 is fitted in the vertical hole 26.

The parallel load check valve 27 is equipped in its valve member 27*a* with a fixed throttle 271. This fixed throttle 271 may have an arbitrary structure but is formed with flat faces 272 and 272 which are cut shallow from the diametrically opposite portions of the outer circumference having a round section of the valve member 27*a*, as shown in FIG. 8-A. Those two flat faces 272 and 272 establish fine clearances (or throttles) between themselves and the inner circumference of the vertical hole 26, thereby to provide the communication between the two staggered end portions 20*a* and 20*b* at all times.

In a position perpendicular to the axis of the spool 19, on the other hand, a signal conduit 14 is formed coaxially with the signal conduit 14 of the traveling section D. The signal conduit 14 of the arm section valve E is opened at a right angle with respect to the spool bore like the foregoing swivel section valve B and the boom II section valve C, and the spool 19 is formed with a ring groove 41 which leads from upstream to downstream only when in the neutral position. On the other hand, the arm section valve E is not formed with the operation signal conduit 15 so that the operation signal conduit 15 of the traveling section valve D has its most downstream closed at the matching face with the arm section valve E. The terminal end of the operation signal conduit 15 may naturally be so blinded as to stop just below the vertical hole 31 of the traveling section valve D.

Moreover, the arm section valve E is formed as its new port with a merging port 36 which is positioned below the lefthand exit neutral passage 23*a*. This merging port 36 is positioned inside of the O-ring 16 so that it requires any special seal. The merging port 36 is opened in the two matching faces and is connected to the entrance neutral passage 22 through a faced hole 37 which is formed in the matching face with the traveling section valve D. Incidentally, the faced hole 37 may not be formed in case no merging into another section is desired.

In the arm section valve E, there are further fitted relief valves 39*a* and 39*b* which are located at the righthand and lefthand of the body 38 to connect the actuator ports 18*a* and 18*b* and the tank passage 21.

Subplate G

Figure 11:
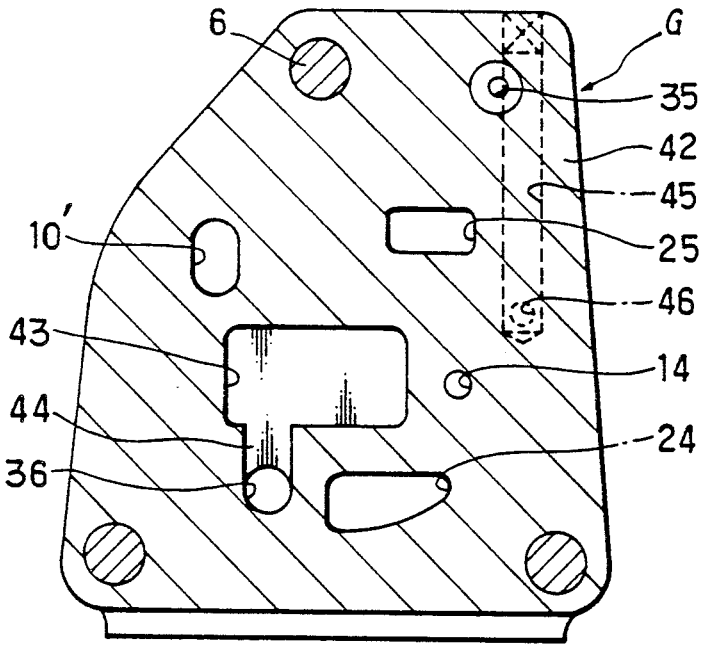
FIG. 11 is a section showing a subplate at the side of the second direction change-over valve group.
Figure 12:
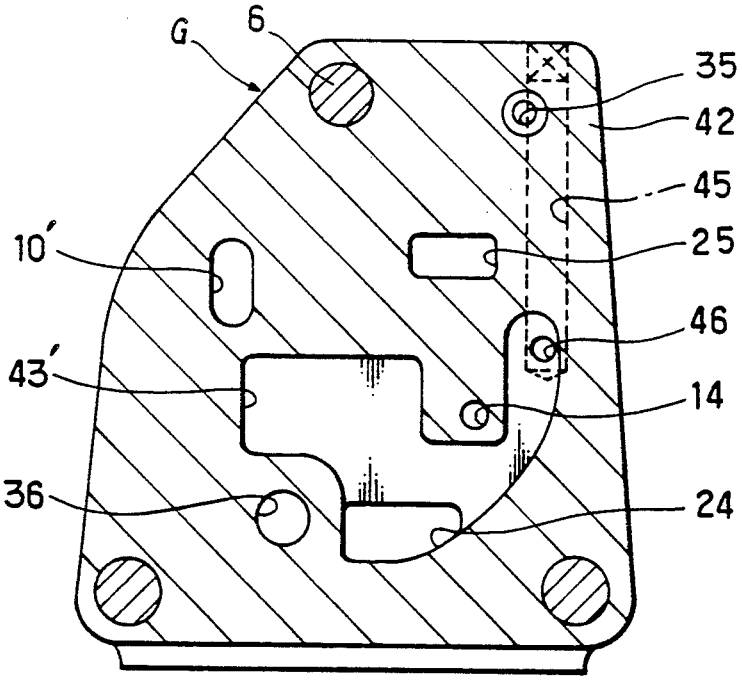
FIG. 12 is a section showing a subplate at the side of the first direction change-over valve group.

FIGS. 11 and 12 show the subplate G, which is used to define the first direction change-over valve group 3 and the second direction change-over valve group 4. FIG. 11 presents a section of a portion near the matching face with the bucket section valve K, and FIG. 12 presents a section of a portion near the matching face with the arm section valve E.

This subplate G has its body 42 formed therethrough with a tank port 24, a pump passage 10', a communication passage 25, a merging port 36 and a signal conduit 14, which extend to the two matching faces, in the same positions as those of the tank port 24, the pump passage 10, the communication passage 25, the merging port 36 and the signal conduit 14 of the aforementioned arm section valve E.

The aforementioned pump passage 10' is sealed up in this embodiment in the matching face of the arm section valve E and need not necessarily be formed in the subplate G but may naturally terminate at the bucket section valve K. On the other hand, the merging port 36 is sealed up by the bucket section valve K.

This subplate G is formed, in the region surrounded by the O-ring, with recesses 43' and 43 which are made to have desired individual depths from the matching faces at the sides of the arm section valve E and the bucket section valve K. These recesses 43' and 43 are out of communication because they are separated by a wall. The recess 43' at the side of the arm section valve E partially communicates with the tank port 24, but the recess 43 at the side of the bucket section valve K does not communicate with the tank port 24.

The body 42 is formed with the drain conduit 35 in the region outside of the outer circumference of the O-ring and in the same position as that of the drain conduit 35 of the aforementioned arm section valve E. The drain conduit 35 of the body 42 is blinded. This body 42 is further formed with a vertical hole 45 which has its upper end closed with a plug and is partially vented to the drain conduit 35. The lower end of the vertical hole 45 is vented to the recess 43' through a blinded horizontal hole 46 which is bored from the side of the arm section valve E. As a result, the drain oil of the communication valve 32 disposed in the traveling section valve D is drained via the drain conduit 35 of the aforementioned arm section valve E to the subplate G and further via the vertical hole 45, the horizontal hole 46 and the recess 43' to the tank port 24.

On the other hand, the recess 43 adjacent to the side of the bucket section valve K is formed at its lower portion with a branched recess 44 which communicates with the merging port 36. The recess 43 is positioned to correspond to the entrance/exit neutral passages of the bucket section valve K so that the flows of oil under pressure from the first hydraulic pump 1 and the second hydraulic pump 2 merge into each other.

Next, the second direction change-over valve group 4 will be described in the following.

Connection Plate H

Figure 13:
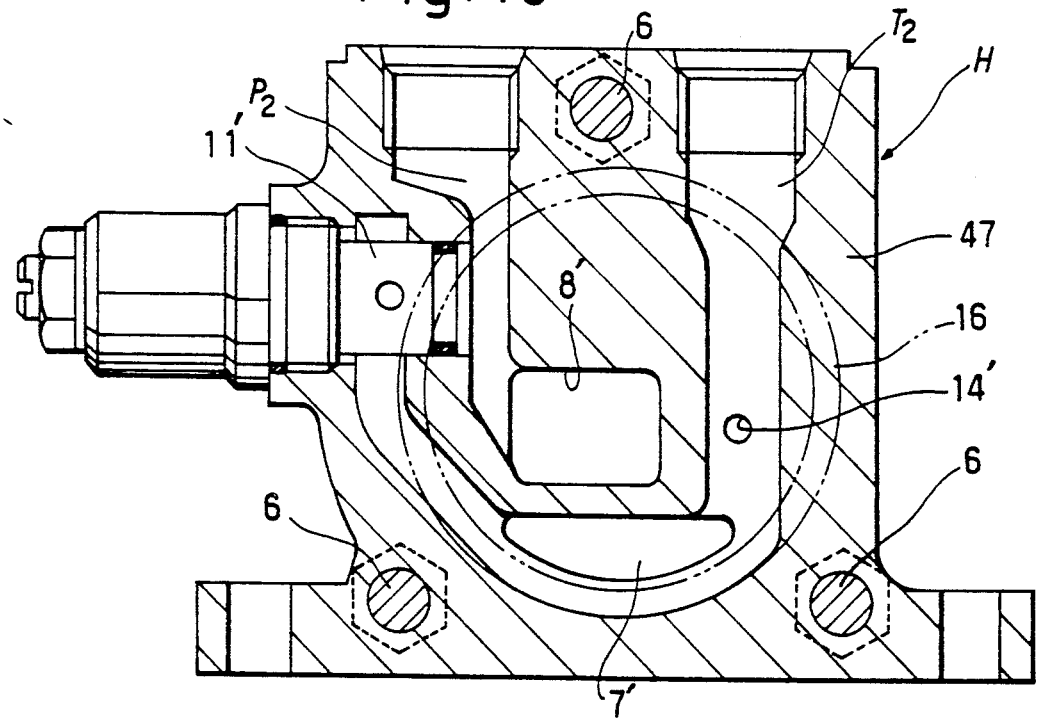
FIG. 13 is a section showing a connection plate of the second direction change-over valve group.

The connection plate H is shown in FIG. 13 to have its body 47 formed with a pump port connected to the second hydraulic pump $P_2$ and an inverted bridge tank port $T_2$ leading to the tank. The pump plate $P_2$ communicates with a larger feed passage 8' at the central portion of the body. On the contrary, the tank port $T_2$ communicates with a tank passage 9', which is so formed through the central portion of the body as to lead to the matching face, and rises in parallel with the pump port. A relief valve 11' is fitted in a horizontal hole, which extends through the rising portion and the pump port $P_2$, to relieve the pressurized oil of the second hydraulic pump 2 to the pressurized oil of the tank passage 9' when the former exceeds a set pressure.

Moreover, the tank port $T_2$ is formed in a portion from the entrance to the tank passage 9' with a signal conduit 14' which leads to the matching face. The aforementioned feed passage 8', tank passage 9' and signal conduit 14' are formed inside of one O-ring 16.

Traveling Section Valve I

Figure 14:
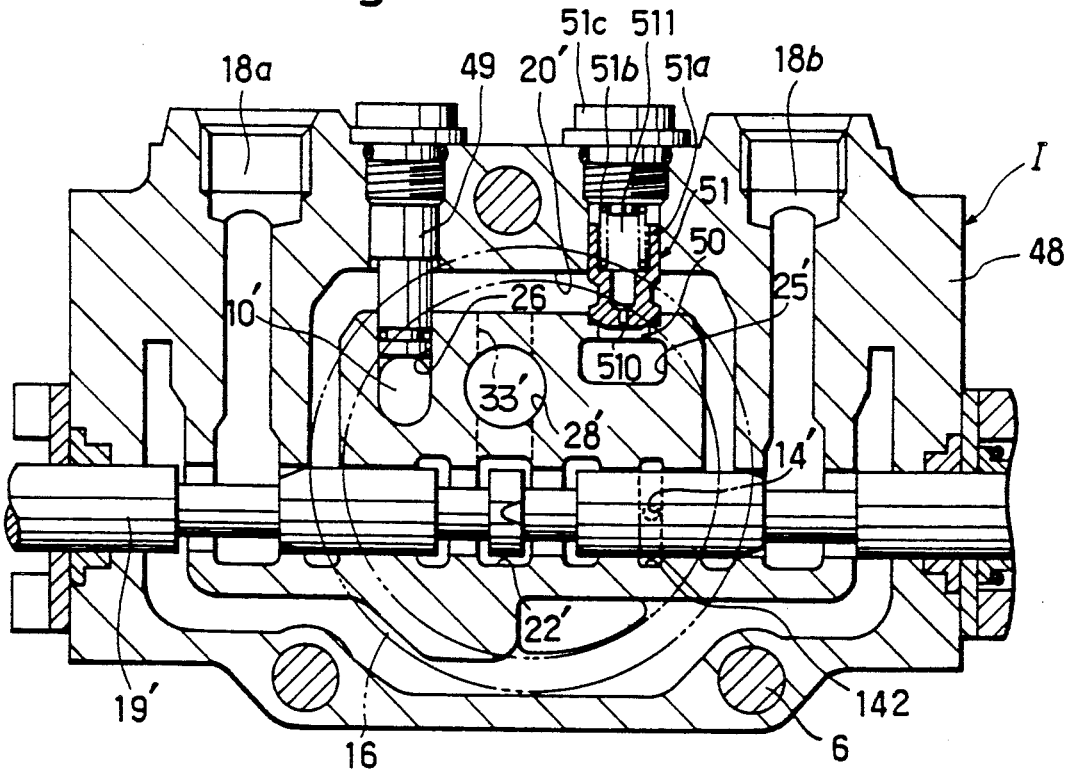
FIG. 14 is a section showing a traveling section valve of the second direction change-over valve group.

The traveling section valve I is shown in FIG. 14. This basic structure is identical to the traveling section valve D in the aforementioned first direction change-over valve group 3, and the actuator ports 18*a* and 18*b* are connected with a traveling hydraulic motor M2', as shown in FIG. 1. Between a bridge passage 20' and a spool bore, there are formed a pump passage 10', a conduit 28' and a communication passage 25' which take the same positions as those of the aforementioned individual section valves. The pump passage 10' and the communication passage 25' extend through the two matching faces and have their one opening closed in the matching face of the aforementioned connection plate H.

The pump passage 10' has its communication blocked from the bridge passage 20' by a plug 49 which is fitted in the vertical hole 26 opened in the upper end of a valve body 48.

On the other hand, the conduit 28' is merely a hole which is formed from the matching face with the boom I section valve J and leads to a conduit 33' connecting the bridge passage 20 and an entrance neutral passage 22', as shown in FIG. 10-B. To the communication passage 25', there leads the lower end of a vertical hole 50 which extends through the bridge passage 20' to the top face of the valve body. In the vertical hole 50, there is fitted a check valve 51 for preventing the back flow from the communication passage 25' to the bridge passage 20'. More specifically, the check valve 51 is equipped with a poppet 51*a* having its leading end facing the vertical hole 50, a spring 51*b* for urging the poppet 51*a* to its closed side, and a plug 51*c* for supporting the spring 51*b*. The poppet 51*a* is formed with a hole 510 which leads to a spring chamber 511. As a result, the check valve 51 is opened by the pressurized oil flowing through the bridge passage 20' to feed the discharged oil of the second hydraulic pump 2 to the communication passage 25'.

This traveling section valve I has its valve body 48 formed therethrough with a signal conduit 14' which extends at a right angle with respect to the spool bore and coaxial with the signal conduit 14' of the aforementioned connection plate H. The spool bore corresponding to the signal conduit 14' is formed into the ring groove 142 like the traveling section valve D of the first direction change-over valve group 3. In the traveling section valve I, therefore, the signal conduit 14' always has its upstream and downstream connected which (neutral or another) position a spool 19' might take.

Boom I Section Valve J

Figure 15:
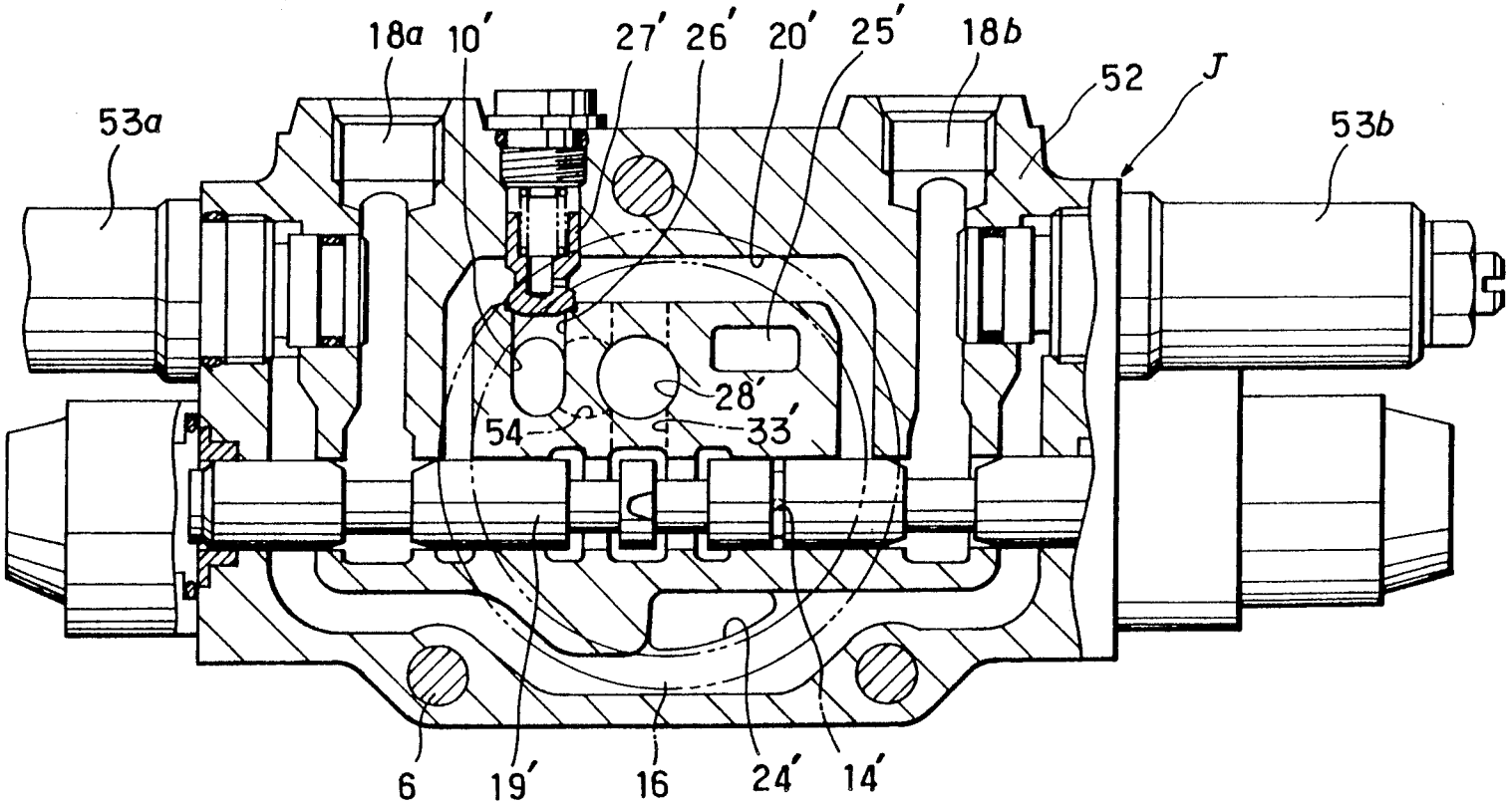
FIG. 15 is a section showing a boom I section valve.

This boom I section valve J is shown in FIG. 15 and has a basic structure identical to those of the aforementioned swivel section valve B and boom II section valve C. Between the bridge passage 20' and the spool 19', more specifically, there are formed a pump passage 10', a conduit 28' and a communication passage 25' which are in identical relation to those of the traveling section I. Below the spool 19', there are formed a tank port 24' and a signal conduit 14' which extends at a right angle with respect to the spool bore. The pump passage 10', the communication passage 25' and the signal conduit 14' are through holes leading to the two matching faces, and the conduit 28' is formed from the matching face with the next bucket section valve K.

The ring groove 141 is so formed that the signal conduit 14' leads to the spool bore and that the spool 19' establishes the communication between the upstream and downstream of the signal conduit 14' only when in the neutral state.

The conduit 28' connected the bridge passage 20' and the entrance neutral passage 22' through the communication conduit 33', as shown in FIG. 10-B. Moreover, a valve body 52 is formed with a vertical hole 26' which extends through the bridge passage 20' to the pump passage 10'. A parallel load check valve 27' is fitted in the vertical hole 26'.

In this boom I section valve J, however, the valve body 52 has relief valves 53*a* and 53*b* fitted at the left-hand and righthand sides for connecting the actuator ports 18*a*' and 18*b*' and a tank passage 21', and the pump passage 10' and the entrance neutral passage 22' are connected through a connecting port 54 crossing the conduit 33'. The connecting port 54 is formed by facing the matching face. The aforementioned actuator ports 18*a*' and 18*b*' are individually connected with external pipes for the actuator ports 18*a* and 18*b* of the boom II section valve C.

Bucket Section Valve K

Figure 16:
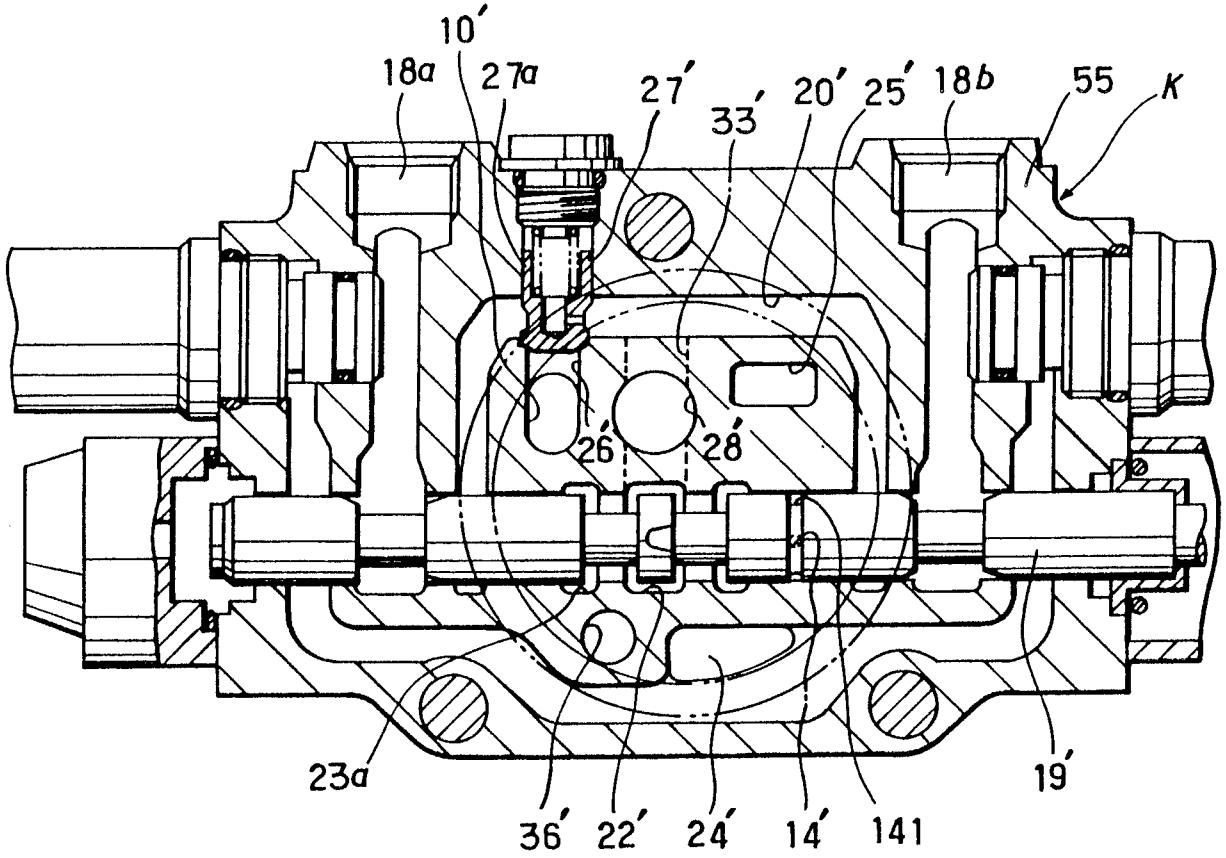
FIG. 16 is a section showing a bucket section valve.

FIG. 16 shows the bucket section valve K. This section valve K also has its body 55 formed therethrough with not only an entrance neutral passage 22' and exit neutral passages 23*a*' and 23*b*' but also a pump passage 10', a communication passage 25', a tank passage 24' and a signal conduit 14'. These pump passage 10', communication passage 25', tank passage 24' and signal conduit 14' are aligned with the individual passages and conduits of the aforementioned boom I section valve J and subplate G. A ring groove 141 is formed in a spool position corresponding to the signal conduit 14' so that the signal conduit 14' has its upstream and downstream communicating with each other only when the spool 19' is in its neutral position.

Between the pump passage 10' and the communication passage 25', moreover, there is formed the conduit 28' which is merely opened in the communication passage 25', as shown in FIG. 10-B, to establish a direct communication between the bridge passage 20' and the entrance neutral passage 22'.

This bucket section valve K is also formed with a vertical hole 26' which extends from the pump passage 10' and is opened in the top face of the body. In this vertical hole 26', there is fitted a parallel load check valve 27' which has the same structure as that of the aforementioned boom I section valve J. Moreover, the section valve K is formed like the aforementioned arm section valve E (as shown in FIG. 8) with a merging port 36' below the entrance neutral passage 22' and the exit neutral passage 23*a*'. Since, however, the matching face is not formed with any faced hole, the merging port 36' has no communication with the aforementioned entrance neutral passage 22' and exit neutral passage 23*a*'. In other words, the merging port 36' is sealed up as a mere through hole in the matching face.

Next, a second embodiment of the present invention will be described in the following with reference to FIGS. 17 and 18.

This second embodiment is characterized in that the discharged oil of the first hydraulic pump 1 is branched and fed through an internal passage by using none of any special hydraulic pumps such as a gear pump as the operating oil pressure source of the communication valve.

As a result, the valve structure is different from that of the first embodiment in the connection plate A and the traveling section valve D of the first direction change-over valve group 3. Incidentally, the arm section valve G and the subplate G, and the connection plate H and the individual section valves I, J and K belonging to the second direction change-over valve group 4 are given absolutely the same structures as those (as shown in FIGS. 8 to 16) of the first embodiment, and their descriptions will be omitted.

Connection Plate A

Figure 19:
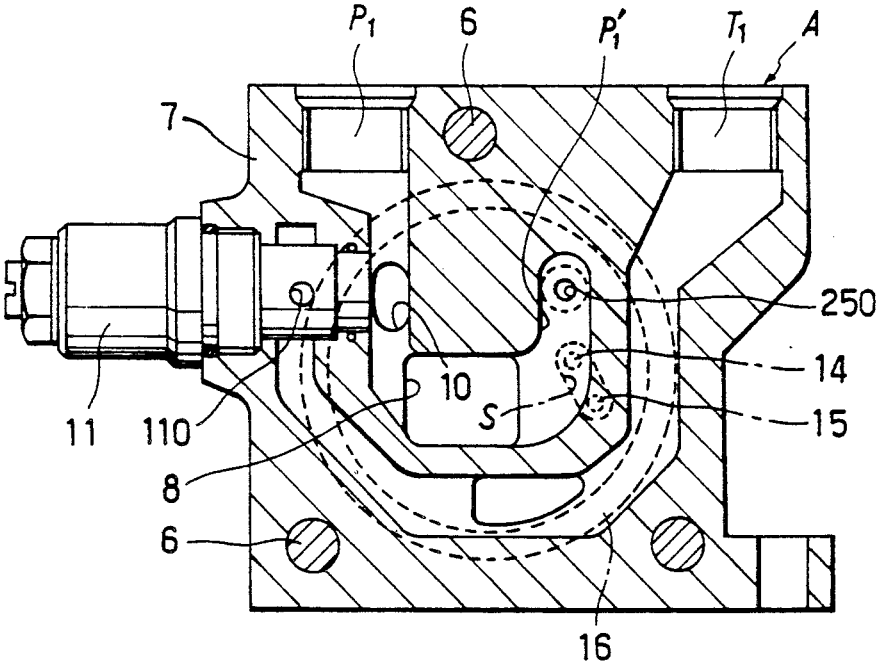
FIG. 19 is a section showing a connection plate of the first direction change-over valve group.
Figure 20:
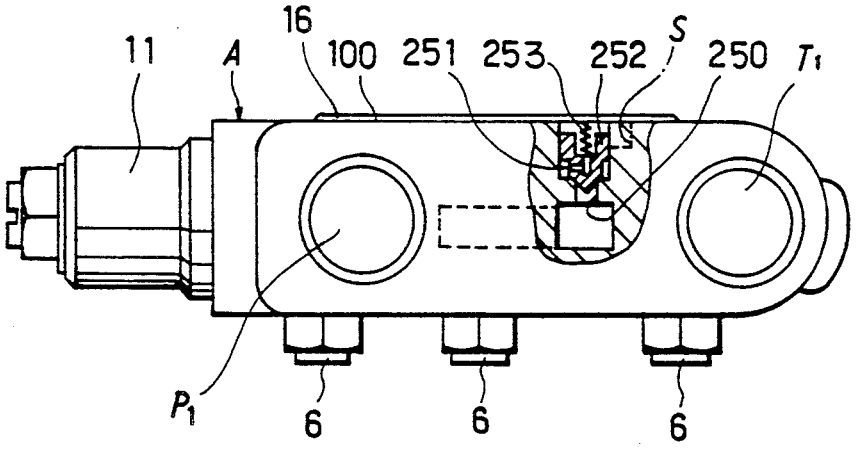
FIG. 20 is a partially cut-away top plan view showing the same.

This connection plate A is shown in FIGS. 19 and 20. The body 7 is so formed with a feed passage 8 and a tank passage 9 below the former that they are opened in the matching face and that the feed passage 8 communicates with a pump port $P_1$ connected to the first hydraulic pump 1. Moreover, the tank passage 9 communicates with an inverted bridge tank port $T_1$. Still moreover, the pump port $P_1$ is formed with a pump passage 10 leading to a matching face 100. A relief valve 11 is fitted across the end portion of the tank port $T_1$ and the pump port $P_1$, and a secondary opening 110 communicates with the tank port $T_1$.

The pump port $P_1$ is formed with a rising portion $P_1'$ across the feed passage 8, and the rising portion $P_1'$ is formed in its end portion with a stepped hole 250 which is opened in the matching face 100. In this stepped hole 250, as shown in FIG. 20, there is so fitted a check valve 252 which is equipped with a throttle 251 that it is normally closed by a spring 253. The hole 250 is provided for forming a branched passage. The other end of the spring 253 is supported by the next swivel section valve B.

Moreover, the matching face 100 is faced with a signal port S for connecting a signal conduit 14, which is formed in a later-described swivel section valve B, and an operation signal conduit 15.

The feed passage 8, tank passage 9, pump passage 10 and signal port (or faced hole) S described above are so centrally arranged in the inside region as not to deteriorate the strength of the body 7. In the matching face 100, there is so fitted an O-ring 16 as to accommodate those passages and conduits in its inside.

Swivel Section Valve B and Boom II Section Valve C

Figure 21:
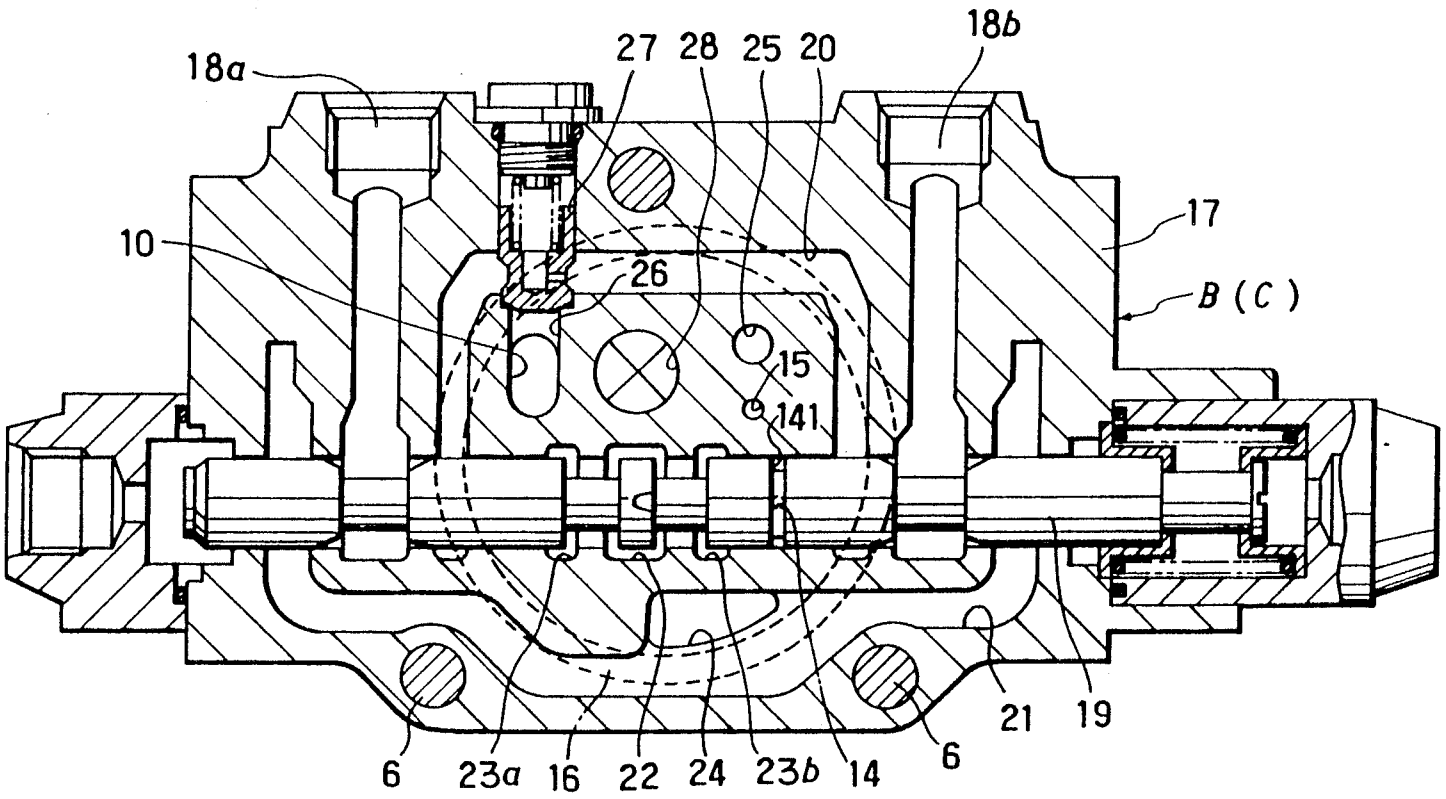
FIG. 21 is a section showing swivel and boom II section valves of the first direction change-over valve group.

FIG. 21 shows the swivel section valve B and the boom II section valve C in their neutral states. These valves have structures identical to those of the swivel section valve B and boom II section valve C of the foregoing first embodiment. Incidentally, the boom II section valve C is omitted from FIGS. 17 and 18.

This second embodiment is different from the first embodiment in that the communication passage 25 is not closed by the matching face of the connection plate A but is connected to the hole 250 of the connection plate A through the check valve 252 with a throttle. In this second embodiment, more specifically, the discharged oil of the first hydraulic pump 1 is throttled and fed to the communication passage 25. Incidentally, the communication passage 25 of this swivel section valve is so thinned at the matching face with the connection plate A as to provide for a face for supporting the spring 253.

Through the swivel section valve B and the boom II section valve C, there is formed, at a right angle with respect to the spool bore, the signal conduit 14 which is opened in the signal port S of the aforementioned connection plate A. Like the structure of the first embodiment, the spool 19 is so formed with the ring groove 141 as to provide the communication between the upstream and downstream of the signal conduit 14 only when in the neutral state.

Between the communication passage 25 and the signal conduit 14, moreover, there is formed therethrough an operation signal conduit 15 which is also opened in the signal port S of the aforementioned connection plate A.

Since the remaining structures are identical to those of the first embodiment, the identical portions and parts are designated at the common reference numerals only, and their descriptions will be omitted.

Traveling Section Valve D

Figure 22:
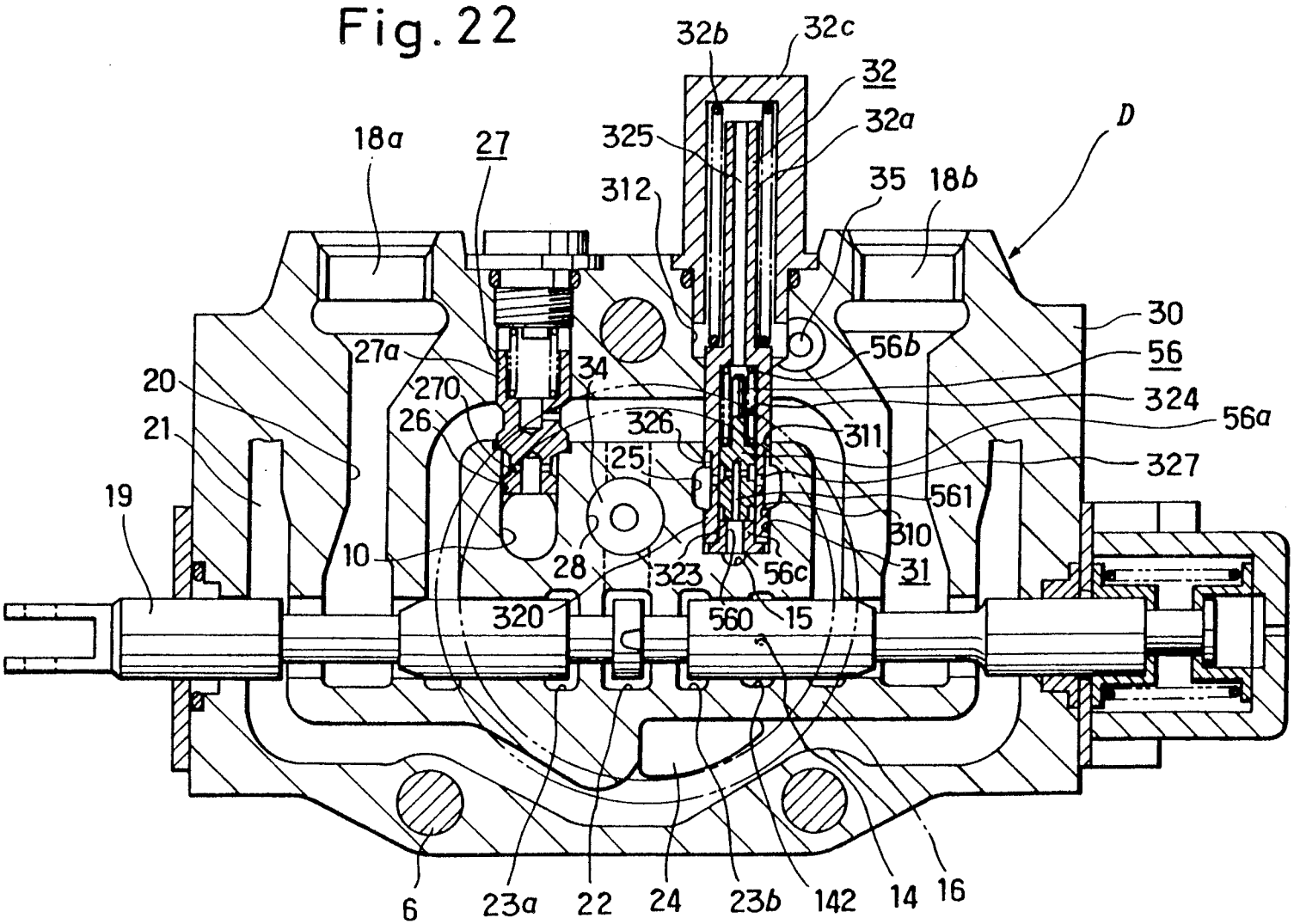
FIG. 22 is a section showing a traveling section valve of the first direction change-over valve group.

FIGS. 22 and 22-A show the traveling section valve D. Since the basic structure of the traveling section valve D is identical to that of the traveling section valve D of the first embodiment, its description will be restricted to the designations of the common reference numerals.

The basic structure is identical to that of the first embodiment in that the valve body 30 is formed with the blinded vertical hole 31 which extends through the bridge passage 20 and the communication passage 25 to the operation signal conduit 15 and in that the communication valve is arranged in the vertical hole 31. What is different resides in that the communication valve 32 is a two-position change-over valve of internal pilot spring offset type and in that a pressure-reducing valve 56 is assembled in the spool 32*a* for establishing/blocking the communication between the bridge passage 20 and the communication passage 25.

More specifically, first of all, the spool 32*a* is formed, as shown in FIG. 22-A, of: a leading end land portion 320 to be fitted in the vertical hole portion 310 below the communication passage 25; a rear end land portion 321 to be fitted in the vertical hole portion 311 between the communication passage 25 and the bridge passage 20; and a rod portion 322 for connecting the land portions 320 and 321. The portion of the spool 32*a* rearward of the rear end land portion 321 is formed into a thin rod projecting upward from the vertical hole 31.

This spool 32*a* is formed into a cylindrical shape, as is different from that of the first embodiment. Specifically, the spool 32*a* is formed, sequentially in the following recited order from its lower end to the upper end, with a threaded bore 323, a reducing valve accommodating hole 324, and an offsetting thin hole 325 which is opened from the ceiling of the hole 324 in the upper end of the spool.

On the other hand, the pressure-reducing valve 56 is composed of a spool-shaped valve body 56*a*, a spring 56*b* for urging the valve body 56*a*, and a flanged plug 56*c* for holding the valve body 56*a* and the spring 56*b* so that they may not come out of the spool 32*a*. The spring 56*b* is so fitted as to be supported by the ceiling of the valve accommodating hole 324, and the valve body 56*a* is then inserted and is received by screwing the plug 56*c* into the threaded hole 323. As shown in FIG. 22-A, the plug 56*c* is such a cylindrical member which is formed therethrough with a conduit 560 communicating with the operation signal conduit 15, and the valve body 56*a* is axially formed from its lower end with a conduit 561 communicating with the conduit 560 at all times. The conduit 561 has its leading end radially branched to communicate with a ring groove 562 which is formed in the outer circumference of the valve body 56*a*.

In the region of the rod portion 322 of the spool 32*a*, on the other hand, there are formed a plurality of holes 327 which extend through the cylindrical wall to the valve hole 324. The holes 327 are positioned to be connected with the ring groove 562 of the valve body 56*a* but disconnected from the ring groove 562 when the valve body 56*a* is lifted in the valve hole 324 by the pressure difference against the urging force of the spring 56*b*.

Incidentally, the communication valve 32 is equipped with a cap 32*c* to be fitted on the valve body 30, and the spring 32*b* has its upper end supported by that cap 32*c* and abuts against the rear end face of the rear end land portion 321. As a result, the spool 32*a* is closed till the pressure of the oil coming from the operation signal conduit 15 to act upon the leading end land portion 320 through the flange of the plug 56*c* reaches a predetermined level. A chamber 312 accommodating the spring 32*c* is formed with an offset signal conduit (or drain conduit) 35 which has its other end reaching the matching face with the arm section valve E. The offset signal conduit 35 is extended to the subplate G, in which it is connected to the tank port.

OPERATIONS

If, in the first embodiment, the first hydraulic pump and the second hydraulic pump are driven, the discharged oil of the first hydraulic pump 1 is fed from the pump port $P_1$ of the connection plate A via the feed passage 8 and the pump passage 10 to the first direction change-over valve group 3, and the discharged oil of the second hydraulic pump 2 is fed from the pump port $P_2$ of the connection plate H via the feed passage 8' to the second direction change-over valve group 4.

In the neutral state of FIG. 1, the working oil having passed through the feed passage 8 is fed into the tank port 24 via the entrance neutral passage 22 and exit neutral passage 23*a*, which are formed through and in the common positions of the swivel section valve B, the traveling section valve D and the arm section valve E, and via the recess 43', which is formed in the subplate G.

Moreover, the working oil having passed through the pump passage 10 flows to the parallel load check valve 27 of the arm section valve E via the pump passages 10 which are formed through the individual section valves, i.e., the swivel section valve B to the arm section valve E. If the load check valve 27 is pushed upward, the working oil is allowed, while having its flow rate throttled through the fixed throttle (i.e., the two-way throttle in the outer circumference in the present embodiment) 271, to flow into the upper staggered end portion 20*a* forming one of the bridge passages 20 until it merges into the working oil which flowed via the entrance neutral passage 22.

On the other hand, the working oil of the second hydraulic pump 2 having passed through the feed passage 8' flows into the recess 43, which is formed in the subplate G, via the entrance neutral passage 22' and exit neutral passages 23*a'* and 23*b'*, which are formed through the traveling section valve I, the boom section valve J and the bucket section valve K.

Moreover, the working oil of the second hydraulic pump 2 partially flows into the bridge passage 20' in the traveling section valve I to push the check valve 51 upward and flows into the communication passage 25' till it flows to the communication passage 25 of the traveling section valve D of the first change-over valve group 3 via the individual communication passages 25' of the boom section valve J, the bucket section valve K and the subplate G and via the communication passage 25 of the traveling section valve D. At this time, however, the communication valve 32 disposed in the traveling section valve D of FIG. 6 shuts out the communication between the communication passage 25 and the bridge passage 20.

The oil under pressure having passed through the neutral passages flows into the merging port 36 via the branched recess 44 which is formed to extend from the recess 43 formed in the subplate G. Since the merging port 36 is formed to extend from the subplate G to the arm section valve E, the working oil flows through those section valves. Since the merging port 36 of the arm section valve E is connected to the entrance neutral passage 22 through the faced hole 37, as shown in FIG. 8, the working oil flows of the first and second direction change-over valve groups 3 and 4 merge into each other in the faced hole 37. Since, moreover, the recess 43' of the subplate G communicates with the tank port 24, the working oil flow is returned to the tank.

On the other hand, the discharged oil of the signal pump 5 is branched to flow from the signal port S of the connection plate A of FIG. 3 into the signal conduit 14 and the operation signal conduit 15. The pilot pressure oil of the signal conduit 14 flows into the tank port $T_2$ in the terminal connection plate H via the signal conduits 14 and 14' which are perpendicular to the axes of the spools 19 and 19' in the neutral states of all the section valves B, C, D, E, F, G, K, J and I. Incidentally, in the two traveling section valves D and I, the pilot pressure oil flows into the downstream section valves via the ring grooves 142 and 142' which are formed in the spool bores.

On the contrary, the pilot pressure oil having passed through the operation signal conduit 15 of the connection plate A flows through the operation signal conduits 15, which are formed in the common positions of the individual swivel, boom II and traveling section valves B, C and D, to act upon the end face of the leading end land portion 320 of the communication valve 32 disposed in the traveling section valve D, as shown in FIG. 6.

If the traveling section valves D and I are operated in that state, the oil flows are switched according to the movements of the spools 19 and 19'. Specifically, the oil coming from the entrance neutral passage 22 (22') flows from the passage 28 (or 28') via the communication conduit 33 (or 33') into the bridge passage 20 (or 20'), and the oil coming from the pump passage 10 (or 10') merges into the aforementioned oil in the bridge passage 20 until it flows out of the actuator port 18*a* or 18*b*.

Thus, the pressurized oil flows from the first and second hydraulic pumps are respectively fed to the traveling motors M2 and M2' to travel the prime mover. Even if the aforementioned spools 19 and 19' are moved, the pilot signals are not blocked in the least because the individual signal conduits 14 and 14' of the traveling section valves D and I are always allowed to communicate between their upstream and downstream by the ring grooves 142 and 142' which are formed in the spool bores.

Let it be assumed that the front prime mover belonging to the first direction change-over valve group 3, e.g., the arm section valve E is operated to actuate the arm. In this case, the pressurized oil flowing through the entrance neutral passage 22 of the arm section valve E is so switched from the neutral state as a result of the movement of the spool 19 that it is fed to the actuator port 18*a* or 18*b* and to the arm cylinder CL2. As a result, the flow rate of the oil to be fed from the first hydraulic pump 1 to the traveling motor M1 is reduced.

In the present invention, however, the ring groove 141 is brought, the spool 19 of the arm section valve E is moved, into a state in which it is blocked from the signal conduit 14 formed in the fixed position in the valve body 38. As a result, the pressure is raised in the signal conduit system (including the series signal conduits 14) so that the elevated pilot pressure is applied to the communication valve 32 in the traveling section valve D via the operation signal conduit 15 communicating with the signal conduit 14.

More specifically, if the leading end land portion 320 in FIG. 6 is pushed upward to enable its pressure to overcome the set urging force of the spring 32*b*, the spool 32*a* is lifted. As a result, the rear end land portion 321 leaves the vertical hole portion 311 to establish the communication between the communication passage 25 and the bridge passage via the rod portion 322. Then, the communication passage 25' extending from the traveling section valve I belonging to the second direction change-over valve group 4 acquires the communication with the communication passage 25 of the first direction change-over valve group 3. As a result, the pressurized oil of the second hydraulic pump 2 is introduced from the communication passage 25' into the communication passage 25. In other words, the pressurized oil flows of the first hydraulic pump and the second hydraulic pump merge into one flow. This oil flow is fed to the actuator port 18*a* or 18*b* from the bridge passage 20 of the traveling section valve D of the first direction change-over valve group 3. Thus, the flow rate of oil necessary for the travel can be retained, even if the arm or the like is moved during the travel of the prime mover, to proceed the prime mover straight smoothly.

Next, the second embodiment will be described in the following. In this second embodiment, the oil under pressure having passed through the pump passage 10 of the section plate A partially flows through the branched passage 250 to open the check valve 252 while having its flow rate throttled by the throttle 251. Then, the throttled oil flows into that communication passage 25 of the swivel section valve B, which leads to the communication passage 32 in the traveling section valve D.

In this second embodiment, the pilot oil pressure is generated by using not the signal pump especially for operating the communication valve 32 but the pressure oil passing through the aforementioned communication passage 25, and the pressurized oil flows of the two hydraulic pump are caused to merge into one in the traveling section valve D.

Specifically, the communication between the signal conduit 14 and the operation signal conduit 15 is established via the signal port S of the connection plate A of FIG. 19, and the signal conduit 14 per se is leads to the tank port $T_2$ in the terminal connection plate H via those signal conduits 14 and 14' of all the section valves B, C, D, E, F, G, K, J and I, which extend at right angles with respect to the axes of the spools 19 and 19' in the neutral states. In the two traveling section valves D and I, the oil flows to the downstream section valves via the ring grooves 142 and 142'.

On the other hand, the signal port S of the connection plate A is formed in the same position of that operation signal conduit 15 of the swivel section valve B, which leads to the plug 56*c* and the pressure-reducing valve body 56*a* formed in the traveling section valve D, as shown in FIG. 22. As shown in FIG. 22-A, moreover, the pressurized oil of the communication passage 25 flows from the radial holes 327 into the spool 32*a* until it flows into the operation signal conduit 15 via the conduit 561 of the valve body 56*a*. The pressurized oil having passed through the conduit 561 acts upon the bottom face of the valve body 56*a* so that it lifts the valve body 56*a* against the spring 56*b*, if it is excessively high, to block the communication between the conduit 561 and the radial holes 327. This makes it possible to reduce the operating pressure of the communication valve 32 to a safe pilot level such as 20 $Kg/cm^2$.

If the arm is moved or turned from this state on the traveling prime mover as in the first embodiment, the signal conduit is shut out to raise the pressure in accordance with the movement of the spools of the working machine section valves. As a result, the raised pilot pressure is applied to the communication valve 32 and the pressure-reducing valve 56 of the traveling section valve D via the communicating operation signal conduit 15.

Specifically, the pilot pressure is applied to the bottom face of the pressure-reducing valve body 56*a* of FIG. 22-A so that the valve body 56*a* is lifted against the spring 56*b* to disconnect the ring groove 562 from the radial holes 372. As a result, the communication passage 25 is disconnected from the operation signal conduit 15. Moreover, the pilot pressure acts upon the plug 56*c* so that the leading end land portion 320 is intensely pushed. If this pressure exceeds the urging force of the setting spring 32*b*, the spool 32*a* of the communication valve 32 is lifted to connect the communication passage 25 and the bridge passage 20 through the rod portion 322.

Then, the chuck valve 51 of the traveling section valve I in the second direction change-over valve group 4 is lifted (or opened) by the oil pressure of the second hydraulic pump 2. Since the communication passage 25' communicates with the aforementioned communication passage 25, the pressure oil flows of the first/second hydraulic pumps 1 and 2 merge into one to flow into the two traveling section valves D. As a result, the necessary oil flow rate can be retained even if the arm or the like is moved during the travel of the prime mover, so that this prime mover can be traveled straight smoothly.

This second embodiment is advantageous not only in that the degree of freedom for arrangement is increased because of the stack type but also in that the communication valves are attached to the traveling section valves so that the operations of the front working machines can be extracted by exploiting the spools and the ring grooves of the spool bores skillfully. As a result, the forward travel of the prime mover can be realized at a reasonable cost without requiring any expensive device such as an electromagnetic valve merely by the operating the travel and the front working machines simultaneously. Since, moreover, the communication valves are of the internal pilot type having the pressure reducing function, in which the pressure-reducing valves are assembled in the spools, the production cost for the system can be reduced without requiring any special signal pump such as a gear pump at the outside.

Incidentally, in either of the first and second embodiments, the bridge passage of the arm section valve E is staggered, as shown in FIG. 8, and the check valve 27 arranged in the staggered end portions 20*a* and 20*b* is formed in its outer circumference with the two-way throttle 271 as a fixed throttle. As a result, the pressurized oil of the pump passage 10 is fed to the bridge passage 20 while being throttled at all times. If the spool 19 is moved leftward, as viewed in FIG. 8, the oil in the entrance neutral passage 22 flows from the upper bridge passage portion to the lower parallel feeder portion while it pushes upward the check valve 27 in the closed state, until it flows out of the actuator port 18*a*. If, on the contrary, the spool 19 is moved rightward, the oil of the entrance neutral passage 22 flows from the upper bridge passage portion to the actuator port 18*b*. Simultaneously with this, the oil of the pump passage 10 flows into the upper bridge circuit while being throttle by the fixed throttle 271. As a result, the oil flow rate can be suited for the individual upward and downward operations of the arm.

Moreover, all of the section valves B, D, E, I, J and K and the connection plates A and H have their various ports accommodated in one O-ring 16. Specifically, there are concentrated in the single O-ring 16 the unloading entrance neutral passage 22, the returning tank passage 24, the parallel pump passages 10 and 10', the communication passages 25 and 25' for the communication valves, the signal core (or conduit) 14 for operating the communication valves, the merging port 36 for connecting the tandem passages, and the load check valve 34 for the tandem passages. These mutual ports of the section valves are metallically sealed in the matching face 100. As a result, no special sealing member need be interposed so that the whole system can be made compact to exploit the space of the prime mover effectively.

What is claimed is:

1. A hydraulic control valve of the type comprising: a first direction change-over valve group 3 connected to a first hydraulic pump 1; and a second direction change-over valve group 4 connected to a second hydraulic pump 2, said first direction change-over valve group 3 including one connection plate A, one traveling section valve D and a plurality of working machine section valves B, C and E, said second direction change-over valve group 4 including one connection plate H, one traveling section valve I and a plurality of working machine section valves J and K, all of said section valves are stacked together with said connection plates, characterized:

(1) in that said connection plates A and H respectively include pump ports $P_1$ and $P_2$ to be fed with the discharged oil from said first hydraulic pump 1 and said second hydraulic pump 2, and tank ports $T_1$ and $T_2$ leading to tanks;

(2) in that the section valves B, C, D, E, I, J and K of said first change-over valve group 3 and said second change-over valve group 4 individually have communication passages 25 and 25' which are formed in their valve bodies near bridge passages 20 and 20' for causing the discharged oil of said second hydraulic pump 2 to merge into the discharged oil of said first hydraulic pump 1, and in that said bridge passage 20' and a communication passage 25' in the traveling section valve I of said second change-over valve group 4 are connected to each other through a check valve 51;

(3) in that said section valves B, C, D, E, I, J and K have their valve bodies formed therethrough with signal conduits 14 on line and at a right angle with respect to spool bores, in that both of said traveling section valves D and I are formed with annular grooves 142 which are formed in the bores of spools 19 and 19' in positions corresponding to said signal conduits 14 for providing communications between the upstreams and downstreams of said signal conduits 14 irrespective of the positions of said spools 19 and 19', in that said working machine section valves B, C, E, J and K other than said traveling section valves D and I are individually formed in their spool portions with annular grooves 141 for providing communications between the upstreams and downstreams of said signal conduits 14 only when said spools 19 and 19' are in their neutral states, and in that said signal conduits 14 have their most downstreams connected with tank passages 9' in the connection plate H of said second change-over valve group 4;

(4) in that the working machine section valves B and C and the traveling section valve D of said first change-over valve group 3 are individually formed with operation signal conduits 15 said communication pasages 25 and said spool bores, and in that said operation signal conduits 15 have their upstreams communicating with the most upstreams of said signal conduits 14 in the connection plate A of said first change-over valve group 3; and (5) in that said traveling section valve D has its valve body 30 formed with a vertical hole 31 which so extends at right angles with respect to said bridge passages 20 and said communication passage 25 as to reach said operation signal conduit 15, in that a communication valve 32 is fitted in said vertical hole 31, and in that said communication valve 32 normally blocks the communication between said communication passage 25 and said bridge passage 20 and is lifted, when the pressure in the operation signal conduit 15 is raised as a result of blocking said signal conduit 14 by operating the working machine section valve, to provide the communication between said communication passage 25 and said bridge, whereby the communication between the other communication passage 25' and said communication passage 25 is provided to introduce the discharged oil of said second hydraulic pump 2 into said bridge passage 20.

2. A hydraulic control valve according to claim 1, characterized: in that the working machine section valves B, C and E of said first direction change-over valve group 3 are provided for working machines of the kind to be also used for travels; in that the working machines J and K of said second direction change-over valve group 4 are provided for working machines to be used not for the travels; in that said first direction change-over valve group 3 is arranged in its most upstream with said working machine section valves B and C having higher priorities and downstream of the former with said traveling section valve D; and in that said second direction change-over valve group 4 is arranged in its most upstream with said traveling section valve I and downstream of the former with said working machine section valves J and K.

3. A hydraulic control valve according to claim 1 or 2, wherein said working machine section valve B is a swirling section valve B, said working machine section valve C is a boom II section valve C, said working machine section valve E is an arm section valve E, said working machine section valve J is a boom section valve J, and said working machine section valve K is a bucket section valve K, characterized: in that said first direction change-over valve group 3 is arranged with its section valves sequentially from the upstream in the order of said swirling section valve B, said boom II section valve C, said traveling section valve D and said arm section valve E; and in that said second direction change-over valve group 4 is arranged with said traveling section valve I, said boom section valve J and said bucket section valve K sequentially from the upstream in the recited order.

4. A hydraulic control valve according to claim 3, characterized: in that at least one of said section valves has its bridge passage 20 staggered at its end portion to form staggered bridge end portions 20*a* and 20*b*; in that a load check valve 27 is fitted across said staggered bridge end portions 20*a* and 20*b*; and in that said load check valve 27 is equipped with a fixed throttle 271 for providing the communications of said staggered end portions 20*a* and 20*b* at all times.

5. A hydraulic control valve according to claim 3, characterized in that said hydraulic control valve includes a neutral passage 22 and a matching face, and in that a tandem load check valve 34 is fitted in the passage connecting said neutral passage 22 and said bridge passage 20 by using said matching face as a stopper.

6. A hydraulic control valve according to any of claims 1 or 2, characterized: in that at least one of said section valves has its bridge passage 20 staggered at its end portion to form staggered bridge end portions 20*a* and 20*b*; in that a load check valve 27 is fitted across said staggered bridge end portions 20*a* and 20*b*; and in that said load check valve 27 is equipped with a fixed throttle 271 for providing the communications of said staggered end portions 20*a* and 20*b* at all times.

7. A hydraulic control valve according to any of claims 1 or 2, characterized in that said hydraulic control valve includes a neutral passage 22 and a matching face, and that a tandem load check valve 34 is fitted in the passage connecting said neutral passage 22 and said bridge passage 20 by using said matching face as a stopper.

8. A hydraulic control valve according to claim 1, characterized: in that the connection plate A of said first direction change-over valve group 3 is formed, separately from said pump port $P_1$, with a signal port S to be connected with an external signal pump 5; and in that said signal port S is connected with the terminals of said signal conduit 14 and said operation signal conduit 15.

9. A hydraulic control valve according to claim 1, characterized: in that the connection plate A of said first direction change-over valve group 3 is formed, in a matching faced with adjacent one of said section valves, with a signal port S of a faced hole; and in that said signal port S is connected with the terminals of said signal conduit 14 and said operation signal conduit 15.

10. A hydraulic control valve according to claim 1, characterized in that said communication valve 32 has a spool 32*a* which is formed with a leading end land portion facing said operation signal conduit 15, a rear end land portion 321 to be fitted in a vertical hole portion 311 between said communication passage 25 and said bridge passage 20, and a rod portion 322 extending between said land portions 320 and 321.

11. A hydraulic control valve according to claim 1, characterized in that said communication valve 32 has a pressure-reducing valve 56 fitted therein to reduce the pressure of the oil coming from said communication passage 25 branched from said pump passage 1, to feed it to said signal conduit 15.

12. A hydraulic control valve according to claim 11, characterized: in that said communication valve 32 has a spool 32*a* which is formed with a leading end land portion facing said operation signal conduit 15, a rear end land portion 321 to be fitted in a vertical hole portion 311 between said communication passage 25 and said bridge passage 20, and a rod portion 322 extending between said land portions 320 and 321; in that said spool 32*a* is formed into a cylindrical shape having a threaded hole 323, an accommodating hole 324 and an offsetting thin hole 325 leading to the upper end of said spool; in that said pressure-reducing valve 56 is equipped with a spool-shaped valve body 56*a*, a spring 56*b* and a plug 56*c* to be fixed in said threaded hole 323; in that said plug 56*c* has a communication conduit 560 leading to said operation signal conduit 15; in that said body 56*a* has a conduit 561 communicating with said conduit 560 at all times; in that the spool 32*a* of said communication valve 32 is formed with a plurality of holes 327 in said rod portion 322; and in that said holes 327 have their communication with said conduit 561 blocked when the body 56*a* of said pressure-reducing valve 56 is lifted.

13. A hydraulic control valve according to claim 1, characterized: in that one sealing O-ring 16 is fitted in the matching face of each of said section valves; and in that there are positioned inside of said sealing O-ring 16 said bridge said bridge passages 20 and 20', a tank port 24, neutral passages 22, 23*a* and 23*b*, said signal conduit 14 and said operation signal conduit 15.

14. A hydraulic control valve according to claim 13, characterized: in that a merging port 36 is formed below said neutral passage and inside of said sealing O-ring 16; in that the communication between said merging port 36 and said neutral passage is provided by a faced hole 37 formed in said matching face to cause the working oils of said first change-over valve group 3 and said second change-over valve group 4 to merge into each other.

* * * * *